US005942859A

United States Patent [19]

Okude et al.

[11] Patent Number: 5,942,859

[45] Date of Patent: Aug. 24, 1999

[54] DISCHARGE LAMP LIGHTING DEVICE

[75] Inventors: Akio Okude; Kouji Noro; Hiromitsu Mizukawa; Jun Kumagai, all of Kadoma, Japan

[73] Assignee: Matsushita Electric Works, Ltd., Osaka, Japan

[21] Appl. No.: 08/865,561

[22] Filed: May 29, 1997

[30] Foreign Application Priority Data

Apr. 18, 1997 [JP] Japan ..... 9-102212
Apr. 18, 1997 [JP] Japan ..... 9-102215

[51] Int. Cl.[6] ..... H05B 37/02

[52] U.S. Cl. ..... 315/291; 315/209 R; 315/307

[58] Field of Search ..... 315/307, 291, 315/224, 247, 246, DIG. 5, DIG. 2, DIG. 7, 209 R

[56] References Cited

U.S. PATENT DOCUMENTS 4,614,898 9/1986 Itani et al. ..... 315/224
4,734,624 3/1988 Nagase et al. ..... 315/243

FOREIGN PATENT DOCUMENTS 63-150895 6/1988 Japan .

*Primary Examiner*—Don Wong
*Assistant Examiner*—David H. Vu
*Attorney, Agent, or Firm*—Lynn & Lynn

[57] ABSTRACT

A discharge lamp lighting device include an inverter circuit section supplying a square wave AC power from a DC power source to a discharge lamp, and a high voltage pulse generating unit applying, upon starting, a high voltage pulse to the discharge lamp to have it started, with an arrangement for lighting the discharge lamp by the square wave AC power made to be lower in the square wave frequency upon non-loading than that upon lighting, and controlling the square wave frequency to remain as that upon the non-loading for a fixed period immediately after detection of the start of discharge of the lamp.

20 Claims, 28 Drawing Sheets

DISCHARGE LAMP LIGHTING DEVICE

BACKGROUND OF THE INVENTION

This invention relates to a discharge lamp lighting device and, more particularly, to a device for lighting such HID lamps as high pressure sodium lamp, metal halide lamp, high pressure mercury lamp and so on with a square wave AC power.

DESCRIPTION OF RELATED ART

For the lighting devices of the HID lamps, ballasts of copper type and iron type have been the main current but, in recent years, they are being replaced by an electronic ballast employing many electronic parts for the purpose of minimizing the weight and dimensions and rendering to be highly functional. Such electronic ballast shall be briefly described in the followings.

In the electronic ballast of the kind referred to, a DC power source circuit section including a rectifying circuit is connected to an AC power source, an inverter circuit part for regulating and controlling a supplied power to the lamp is connected to output end of the DC power source circuit section, and the lamp is connected to an output end of the inverter circuit section.

In the electronic ballast, more concretely, the DC power source circuit section comprises a rectifying circuit and a capacitor, and functions to rectify and smooth an AC voltage of AC power source into a DC voltage, while the inverter circuit part is constituted by a voltage dropping chopper circuit, polarity inverting circuit, igniter circuit and control circuit. The voltage dropping chopper circuit comprises a switching element, diode, inductor and capacitor, which are arranged for generating at the capacitor a voltage dropped from an input voltage with ON/OFF operation at a high frequency of the switching element. In this case, the switching element turned ON causes a source current to flow from the DC power source circuit section through the switching element and inductor to the capacitor, and the switching element turned OFF causes a current of accumulated energy in the inductor to flow through the capacitor and diode. The polarity inverting circuit comprises switching elements forming a full-bridge circuit, in which the respective switching elements are supplying through the control circuit to the lamp a square wave voltage of a lower frequency in non-load state than that in lighting state. The igniter circuit is formed by a pulse transformer, capacitor, such switching element as a sidac or the like voltage response element, and resistor. The operation of this igniter circuit is briefly described with reference to FIG. 32. In this case, the capacitor is gradually charged by a square wave voltage produced at the polarity inverting circuit, with a time constant determined by the resistor and capacitor. As the voltage of the capacitor reaches a breakover voltage of the switching element, the switching element is turned ON, to have an accumulated charge in the capacitor discharged through the capacitor, switching element and a primary winding of the pulse transformer, upon which a pulse voltage generated at the primary winding of the pulse transformer is boosted, and a high pulse voltage (of several kV) is generated at a secondary winding of the pulse transformer and is superposed on a lamp voltage. With this high pulse voltage, the lamp is made to start its discharge and shifts to a lighting state.

The control circuit is to detect the lamp voltage (which may be a lamp current or lamp power) to control the ON/OFF operation of the switching elements in response to the detected value and to regulate the power supplied to the lamp. When this ON/OFF operation of the switching elements is considered, the power control is carried out normally in response to the lamp voltage (lamp current or lamp power) in the lamp lighting state, as has been referred to, whereas in the non-load state a constant power control preliminarily set is performed. Now, provided that a switching element is controlled under the pulse width modulation (PWM) control at a constant frequency, for example, an ON width of this switching element (ON duty: the rate of ON period in 1 cycle of switching) is as shown in FIG. 33 and is controlled with a constant ON width T1 in the non-load state but, when the lamp is lighted, the control is made with an ON width according to the state of the lamp. Here, the ON width is made substantially constant at a portion adjacent to a rated lamp voltage, since the lamp power is attempted to be kept substantially constant with respect to any fluctuation in the lamp voltage. Whether or not the state is of non-load is discriminated by means of the lamp voltage or the like, upon which a threshold level is set at a higher level than the lamp voltage at the time of normal lighting, so that the lamp voltage in a relationship of V1a>V1 is discriminated to be of the non-load state and the ON width is set to be constant at T1.

The circuit arrangement of the kind referred to has been also disclosed in U.S. Pat. No. 4,734,624.

In such well-known discharge lamp lighting device as has been referred to, a detection of the lighting state immediately after the lamp starting should result in that the frequency of the square wave at a low frequency becomes to be abruptly high (from several ten Hz to several hundred Hz) and the ON width of the switching element becomes also abruptly small (T1→T0), so that there has been a problem that, in a state where the discharging immediately after the starting is unstable, the discharge can hardly be maintained, the lighting is not shiftable in smooth manner to a constant lighting, and the starting characteristic is deteriorated.

In order to eliminate such problem, there has been suggested in Japanese Patent Laid-Open Publication No. 63-150895 a device in which the operation of polarity inverting circuit immediately after the detection of the starting of lamp discharge is sufficiently prolonged over a constant cycle in the constant lighting state(see FIG. 34). With this device, however, a pair of switching elements on one side of the polarity inverting circuit have to be kept in ON state for a certain fixed period, a special control means is required to be added for this purpose, and the control circuit has to be complicated enough to be another problem.

Further, an improvement in the lamp starting characteristic has been suggested in U.S. Pat. No. 4,614,898, in which a high frequency power is applied to the lamp immediately after the starting of discharge and the power is changed to be of a low frequency after the lighting is made stable, but the same trouble as in the above publication arises in rendering the control circuit to be complicated in order to produce the high frequency power immediately after the starting of discharge. As further measures for improving the startability of the lamp, it has been also known to increase the energy of the high pulse voltage (its peak value, width, pulse number and so on), but this causes the igniter circuit to be enlarged in dimensions and costs and cannot be the optimum measures. Further, as measures for improving the starting characteristic by increasing a forced current to the lamp immediately after the start of discharge, it is possible (a) to increase secondary voltage in non-load state, (b) to increase the capacity of capacitor parallel to the lamp, (c) to increase secondary short-circuit-current, and so on. In these respects, however, (a) requires high withstand voltage parts in the inverter circuit so as to render the circuit enlarged in the dimensions and costs and cannot be the optimum measure; (b) renders the capacitor to be larger in size and also a steep current flowing immediately after the start of discharge to be larger, so as to similarly enlarge the dimensions and costs of the inverter circuit, and cannot be the optimum measure; and (c) less requires any parts to be enlarged but involves a problem that a large current has to be made to flow to the lamp always in starting process immediately after the start of discharge, so as to shorten the life of the lamp.

SUMMARY OF THE INVENTION

The object of the present invention is to provide a discharge lamp lighting device capable of eliminating the foregoing problems and improving the starting characteristic without causing constituent control circuit to be complicated but with inherent life of the lamp maintained.

In order to realize the above object, the discharge lamp lighting device according to the present invention which comprises an inverter circuit section supplying a square wave AC power from a DC power source circuit section to a discharge lamp, and a high voltage pulse generating means for applying a high voltage pulse to the discharge lamp upon starting so as to have the lamp started thereby, the discharge lamp being lighted with a square wave AC power of a square wave frequency lower in non-load state than that in lighting state, is characterized in that the square wave frequency is controlled to remain at the frequency in the non-load state for a fixed period immediately after detection of the start of discharge of the lamp.

Other objects and advantages of the present invention shall become clear as the description of the invention advances with reference to preferred embodiments of the invention shown in accompanying drawings.

Figure 1:
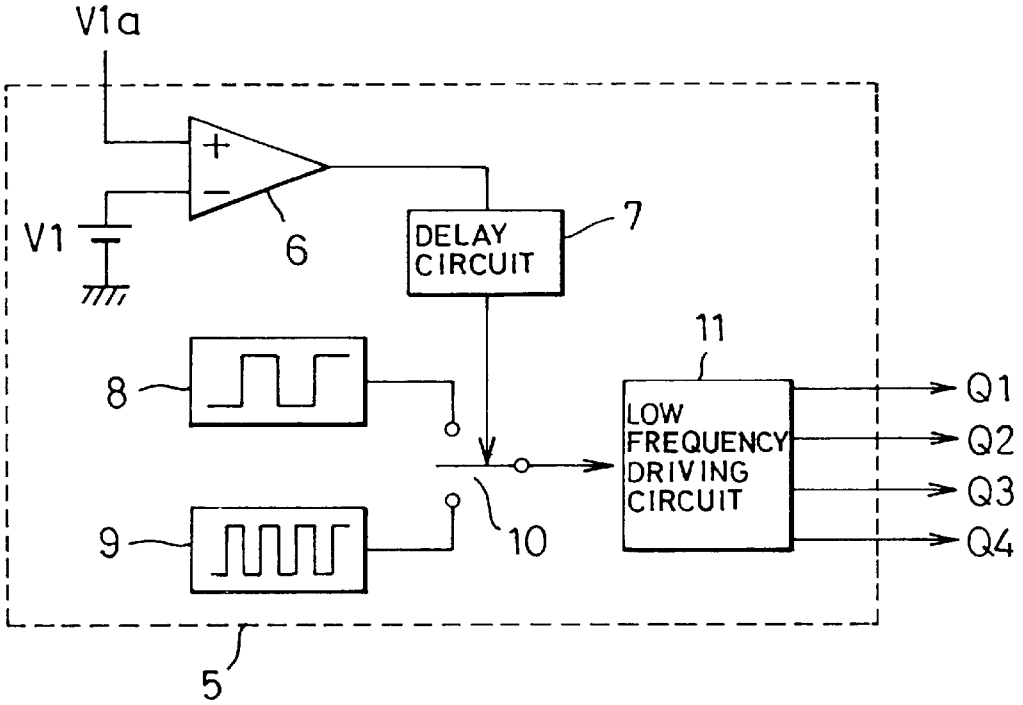
FIG. 1 is a circuit diagram showing main constituents of the discharge lamp lighting device in an embodiment according to the present invention.

While the present invention shall now be described with reference to the respective embodiments shown in the drawings, it should be appreciated that the intention is not to limit the present invention only to these embodiments shown but rather to include all alterations, modifications and equivalent arrangements possible within the scope of appended claims.

DETAILED DESCRIPTION OF THE PREFERRED EMBODIMENTS

Embodiment 1

Figure 1A:
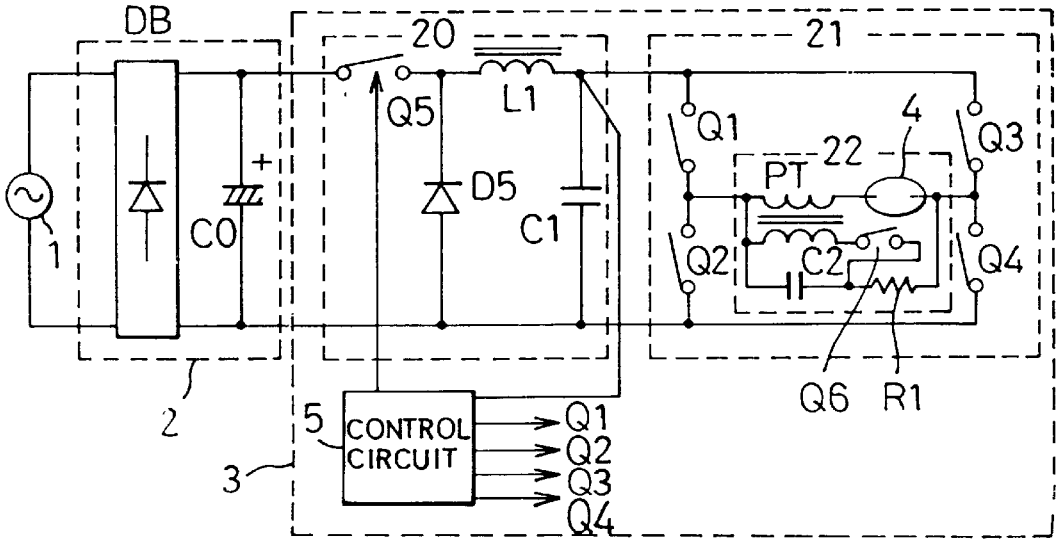
FIG. 1A is a concrete circuit diagram employed in the discharge lamp lighting device of FIG. 1.

In FIG. 1, there is shown an arrangement of main constituents of the discharge lamp lighting device in a first embodiment of the present invention, in which such main circuit as shown in FIG. 1A is employable. In the instant embodiment, the device is so arranged that, even when the start of discharge in a discharge lamp 4 is detected by a lighting discrimination circuit 6, its output of a detection signal is delayed for about several seconds by means of a delay circuit 7, and a frequency of a square wave AC power to the discharge lamp is maintained at a frequency of the power in non-load state for several seconds immediately after the lamp lighting. The instant embodiment shall be further described in detail.

Figure 1B:
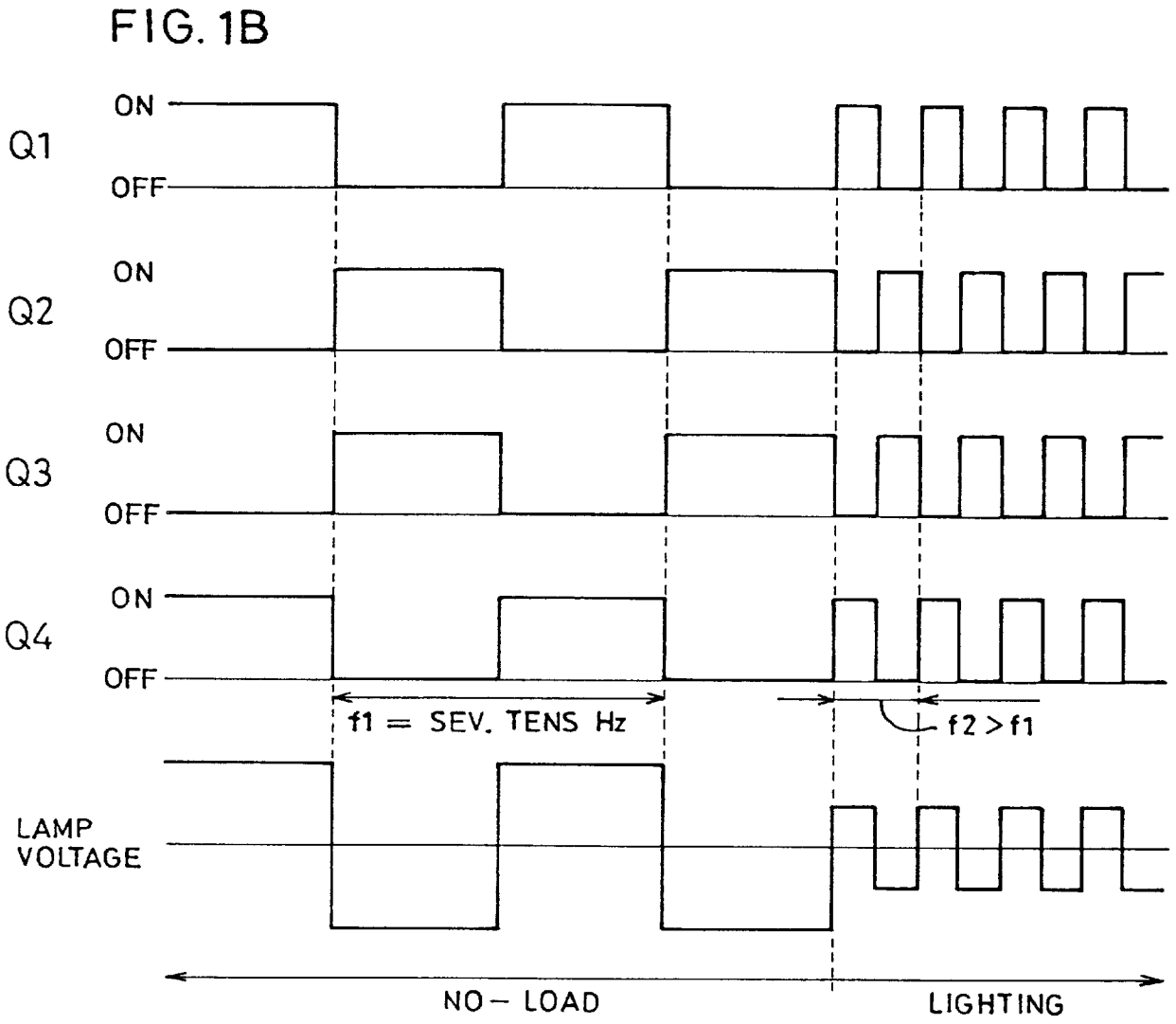
FIG. 1B is an operational waveform diagram of the circuit in FIG. 1A
Figure 2:
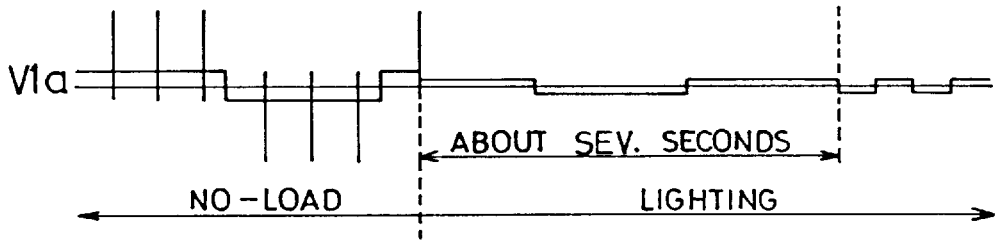
FIG. 2 is an operational waveform diagram immediately after the start in the embodiment of FIG. 1.

In FIG. 1, part of a control circuit 5 (a control part of a polarity inverting circuit section), in which the lighting discrimination circuit 6 compares a lamp voltage V1a with a lighting discrimination voltage V1 preliminarily set so that a signal of "Low" level will be output when V1a>V1 (non-load state) and a signal of "High" level will be output when V1a≦V1 (lighting state). These signals are provided to the delay circuit 7 so that, when the "Low" level signal from the lighting discrimination circuit 6 is changed to the "High" level signal, the "High" level signal will be output as delayed by about several seconds. Oscillators 8 and 9 oscillate to provide signals respectively of a square wave frequency in non-load state (several ten Hz) and of a square wave frequency in lighting state (several hundred Hz). A frequency change-over switch 10 connects the delay circuit 7, in response to the output signals of the circuit 7, to the oscillator 8 when the signal is of the "Low" level (non-load state) and to the oscillator 9 when the signal is of the "High" level (lighting state). A low frequency driving circuit 11 subjects the signals from the oscillators 8 and 9 to a frequency division, to produce signals for such ON/OFF operation as shown in FIG. 1B of respective switching elements Q1–Q4 included in a polarity inverting circuit section 21. With such circuit arrangement as in the above, it is enabled to prevent the discharge lamp from flickering out and to improve the starting characteristic by means of the square wave frequency maintained at several ten Hz in the non-load state for several seconds immediately after the starting of lighting in which the discharge is still unstable. In FIG. 2, there is shown the development in waveform of the lamp voltage V1a immediately after the start of lighting in the present embodiment.

Embodiment 2

Figure 3:
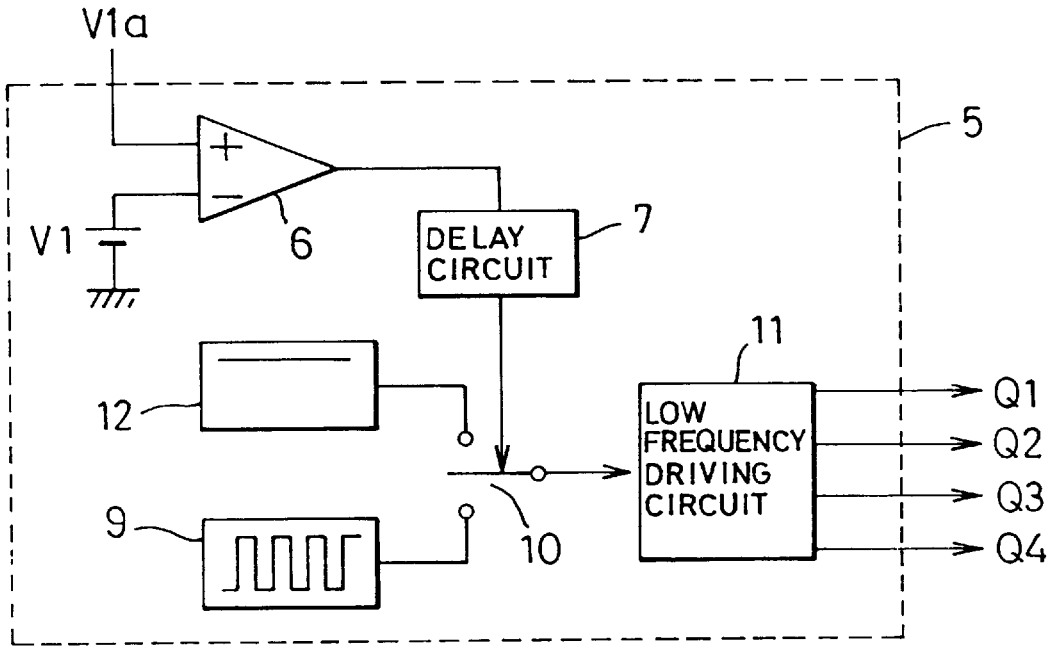
FIG. 3 is a circuit diagram showing the main constituents of the device in another embodiment according to the present invention.

FIG. 3 shows a main part arrangement in a second embodiment of the discharge lamp lighting device. The arrangement of FIG. 1A is also employable as the main circuit of this device. In the present instance, the polarity inversion is not performed in the non-load state and a DC power is supplied to the discharge lamp 4. In this case, the present embodiment is so arranged that, even upon detection of the start of discharging in the lamp by the lighting discrimination circuit 6, the detection signal can be delayed by the delay circuit 7 for about several seconds, and the DC power supplied in the non-load state is maintained during several seconds immediately after the lamp lighting. The present embodiment shall be further detailed in the followings.

Figure 4:
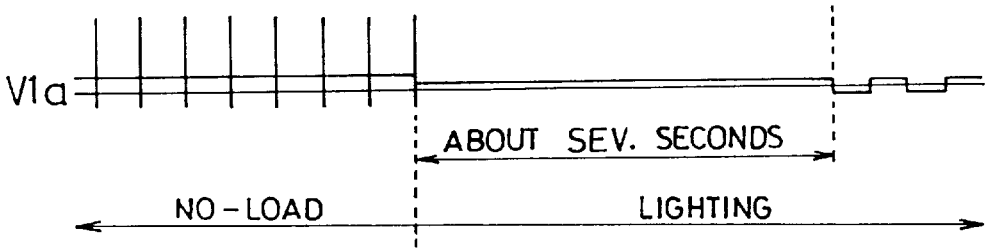
FIG. 4 is an operational waveform diagram immediately after the start in the embodiment of FIG. 3.

In FIG. 3, part of the control circuit 5 (control part of the polarity inverting circuit section) is shown, in which a DC output section 12 is provided instead of the low frequency oscillator 8, and other respects of the arrangement are the same as those in the embodiment of FIG. 1. With this circuit arrangement, the power applied to the discharge lamp is maintained to be the DC power in the non-load state, so that the lamp is prevented from extinguishing and the starting characteristic of the lamp can be improved. In FIG. 4, the process of the lamp voltage waveform immediately after the start of lighting in the present embodiment is shown.

Embodiment 3

Figure 5:
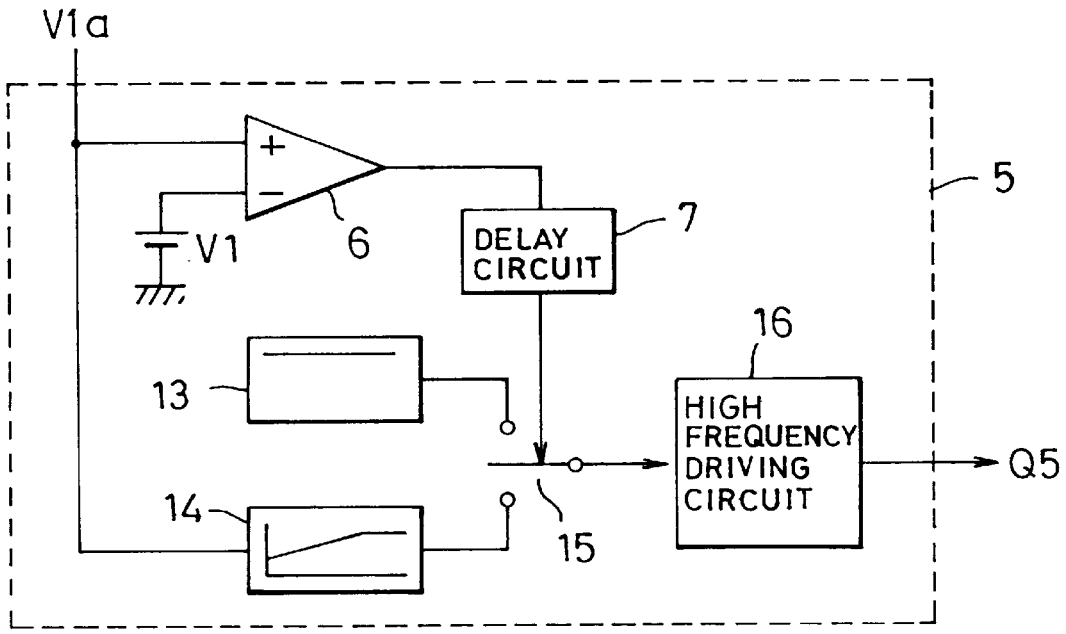
FIG. 5 is a circuit diagram showing the main constituents of the device in another embodiment according to the present invention.

FIG. 5 shows the main part arrangement of a third embodiment is shown. As the main circuit of this discharge lamp lighting device, the arrangement of FIG. 1A is employable. In the present embodiment, the detection signal of the lighting discrimination circuit 6 as to the start of discharge is delayed by the delay circuit 7 for about several seconds, so that ON width of a switching element Q5 will be maintained as unchanged from that in the non-load state for several seconds immediately after the lamp lighting. The present embodiment shall be further detailed in the followings.

Figure 6:
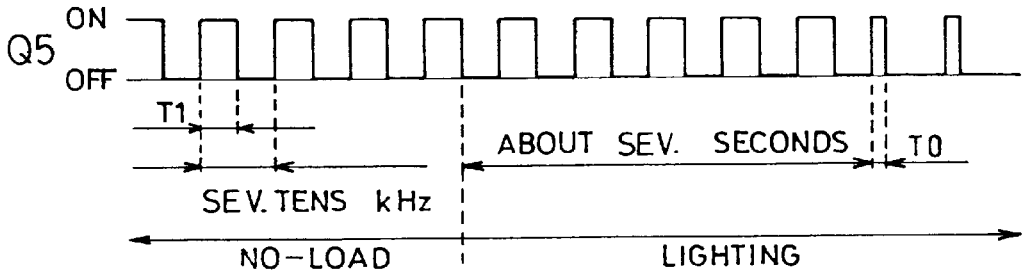
FIG. 6 is an operational waveform diagram immediately after the start in the embodiment of FIG. 5.

FIG. 5 shows part of the control circuit 5 (control part of a high frequency switching element Q5 in a voltage-dropping chopper circuit section 20 of FIG. 1A). ON width setting circuits 13 and 14 are to provide respectively a constant ON width signal in the non-load state and a variable ON width signal responsive to the lamp voltage upon the lighting of lamp. An ON width change-over switch 15 is provided, in accordance with the output signals from the delay circuit 7, to connect the circuit 7 to the constant ON width setting circuit 13 upon receiving the "Low" level signal or to the variable ON width setting circuit 14 upon receipt of the "High" level signal. A high frequency driving circuit 16 receives the signals from the ON width setting circuits 13 and 14, and produces ON/OFF signals in accordance with the state of the lamp through an incorporated PWM controller of oscillation signals of several ten kHz. With the above circuit, the ON width of the switching element Q5 is maintained to be as wide as that in the non-load state for several seconds immediately after the start of lighting in which the discharge state is unstable, so that the discharge lamp can be prevented from extinguishing and can be improved in the starting characteristic. In FIG. 6, there is shown the process of switching state of the switching element Q5 immediately after the start of lighting in the present embodiment, in which T1 denotes the ON width in the non-load state and T0 denotes an ON width corresponding to the lamp voltage immediately after the lighting.

While in the above the PWM controller of the fixed frequency has been referred to as an example of means for controlling the switching element Q5, this may be a circuit for controlling the frequency with the fixed ON width, and it should be also optimum, for example, to maintain the frequency in the non-load state as it is for the period of several seconds right after the lighting so long as the frequency in the non-load state is higher than that immediately after the lighting.

Embodiment 4

Figure 7:
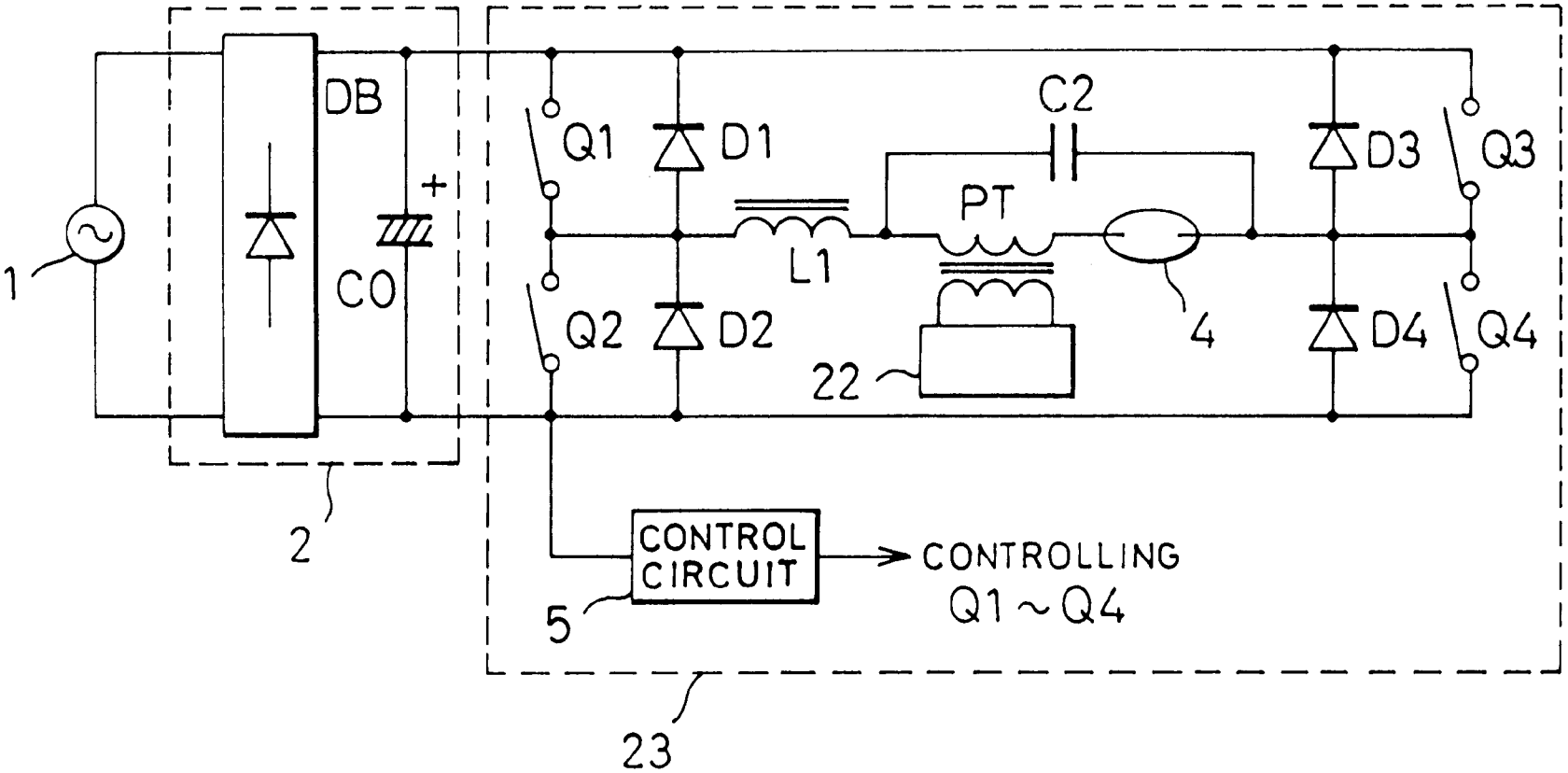
FIG. 7 is a circuit diagram showing the whole arrangement of the device in another embodiment according to the present invention.
Figure 8:
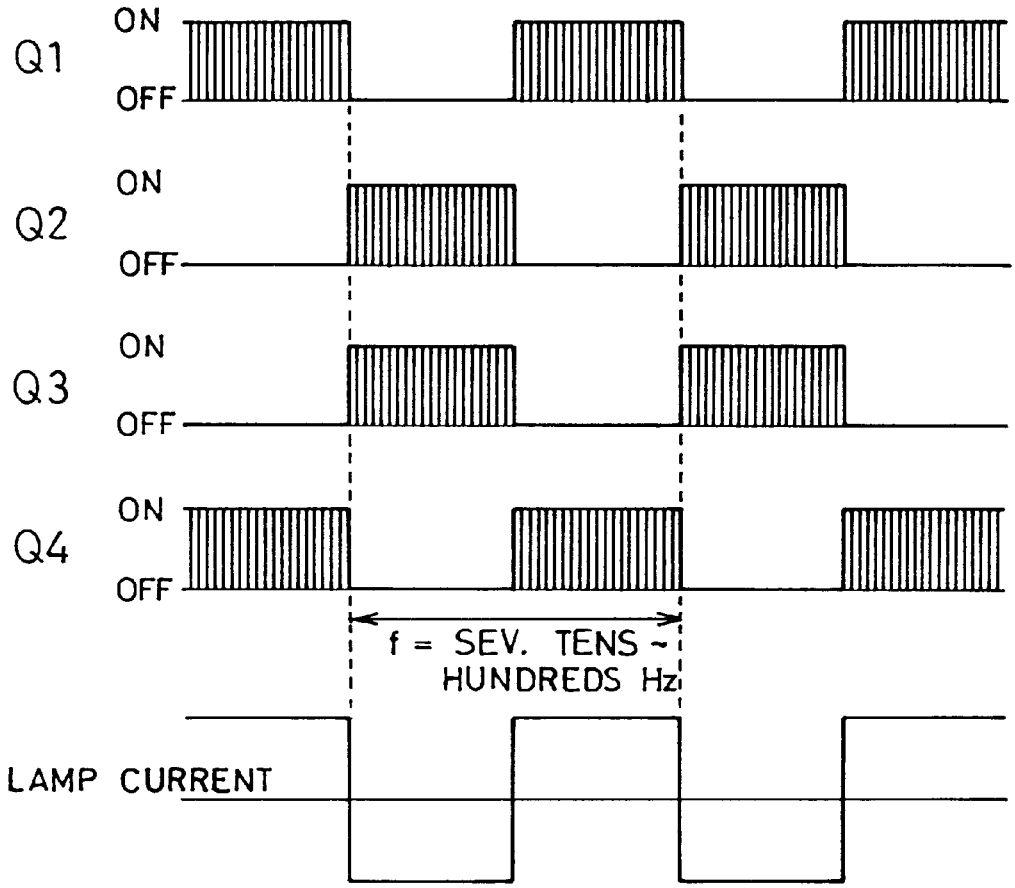
FIG. 8 is an operational waveform diagram of the embodiment in FIG. 7.

FIG. 7 shows an arrangement in a fourth embodiment, in which, referring in conjunction with FIG. 1A, voltage dropping chopper circuit section 20 and polarity inverting circuit section 21 are constituted by a single full-bridge circuit 23, and FIG. 8 shows ON/OFF operation of the switching elements Q1–Q4 in the circuit 23 and a lamp current waveform. In the followings, this circuit shall be detailed. A pair of the switching elements Q1 and Q4 and another pair of the switching elements Q2 and Q3 repeat a high frequency switching as shown in FIG. 8. That is, the switching elements Q1 to Q4 as well as Q5 in FIG. 1A are used to realize both of the polarity inverting operation and the voltage dropping chopper operation. Further, in the cycle in which the switching elements Q1 and Q4 are performing the high frequency switching, an energy of an inductor L1 is subjected to a feedback through diodes D2 and D3 to the power source in the OFF state but, in another cycle in which the switching elements Q2 and Q3 are making the high frequency switching, the energy feedback of the inductor L1 occurs through diodes D1 and D4 in the OFF state. That is, these diodes D1 to D4 are performing the function of a diode D5 in FIG. 1A.

With the above operation, the same square wave AC current as in Embodiment 1 can be obtained, and the same control as in Embodiment 1 can be made possible. Further, when such element incorporating the diode as FET is employed instead of the switching elements Q1 to Q4, the function of the diodes D1 to D4 may be performed by such elements, so that the number of the switching elements and diodes employed can be reduced to four, in contrast to six in the case of Embodiment 1, and the use of FET or the like will be advantageous in the cost reduction and dimensional minimization.

Embodiment 5

Figure 9:
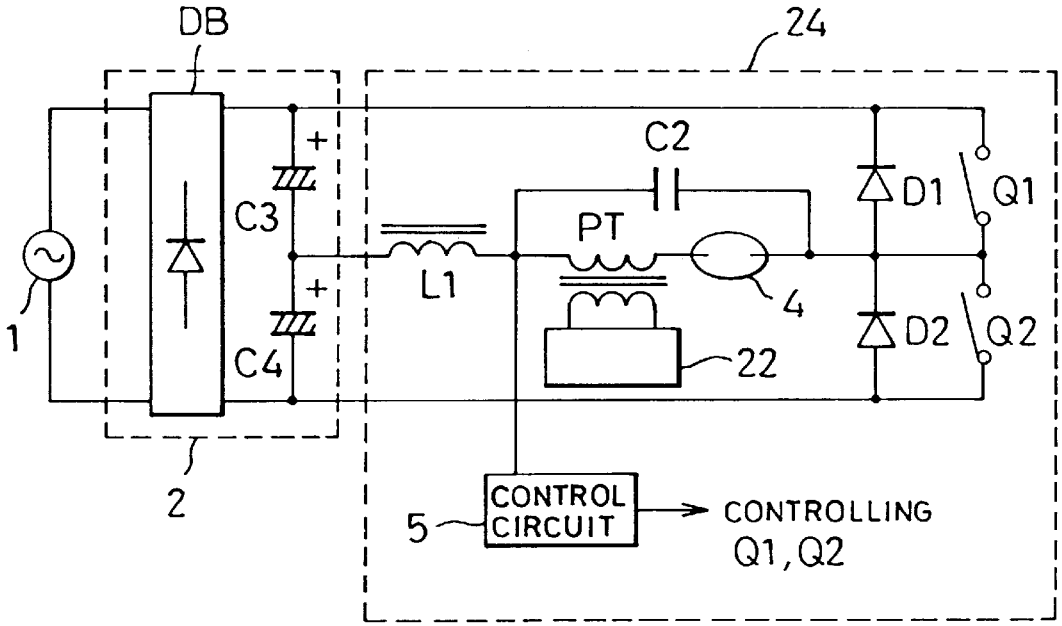
FIG. 9 is a circuit diagram showing the whole arrangement of the device in another embodiment according to the present invention.
Figure 10:
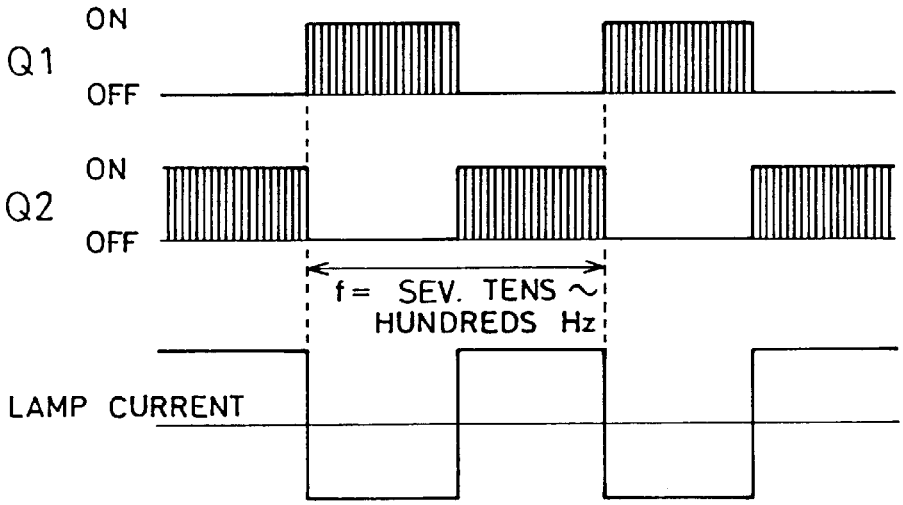
FIG. 10 is an operational waveform diagram of the embodiment in FIG. 9.

FIG. 9 shows a fifth embodiment, in which the function of the voltage dropping chopper circuit section 20 and polarity inverting circuit section 21 in Embodiment 1 is realized by a half bridge circuit 24, and FIG. 10 shows ON/OFF operation of the switching elements Q1 and Q2 and a lamp current waveform. This circuit shall be detailed in the followings. The switching elements Q1 and Q2 repeat such high frequency switching as shown in FIG. 10, that is, the switching elements Q1–Q4 and Q5 are used for both purposes. Further, in the cycle in which the switching element Q1 performs the high frequency switching, the energy in the inductor L1 is fed back through the diode D2 to a capacitor C4 in the OFF state, and, in the cycle in which the switching element Q2 is switching at the high frequency, the energy of the inductor L1 is fed back through the diode D1 to a capacitor C3 in the OFF state. That is, the diodes D1 and D2 are performing the function of the diode D5 in the circuit of FIG. 1A.

With the foregoing operation, the same AC current as in Embodiment 1 can be provided to the lamp, and the same control as in Embodiment 1 can be executed. When such elements as FET's incorporating the diodes are employed as the switching elements Q1 and Q2 in the present embodiment, the incorporated diodes can be used as the diodes D1 and D2, so that required number of the switching elements and diodes will be respectively two, to be less than the number of six in Embodiment 1, and this will be advantageous in the cost reduction and dimensional minimization.

In the foregoing embodiment, part of the discharge lamp lighting device has been referred to, and references to the whole circuit arrangement are omitted, but an application of the embodiment to a practical discharge lamp lighting device will be as follows.

Embodiment 6

Figure 11:
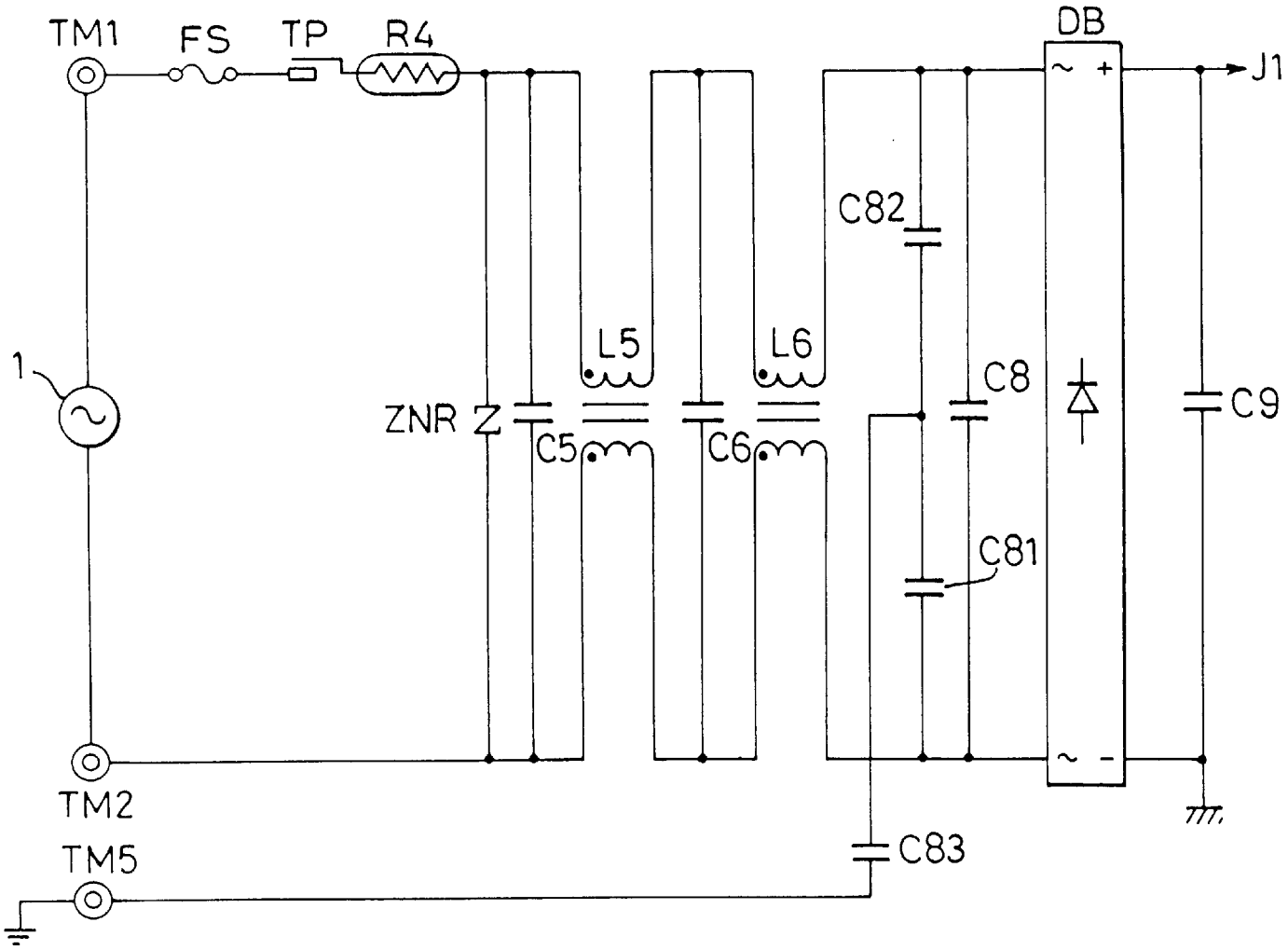
FIG. 11 is a circuit diagram of a source power input section in a practical product of the discharge lamp lighting device embodying the present invention.
Figure 12:
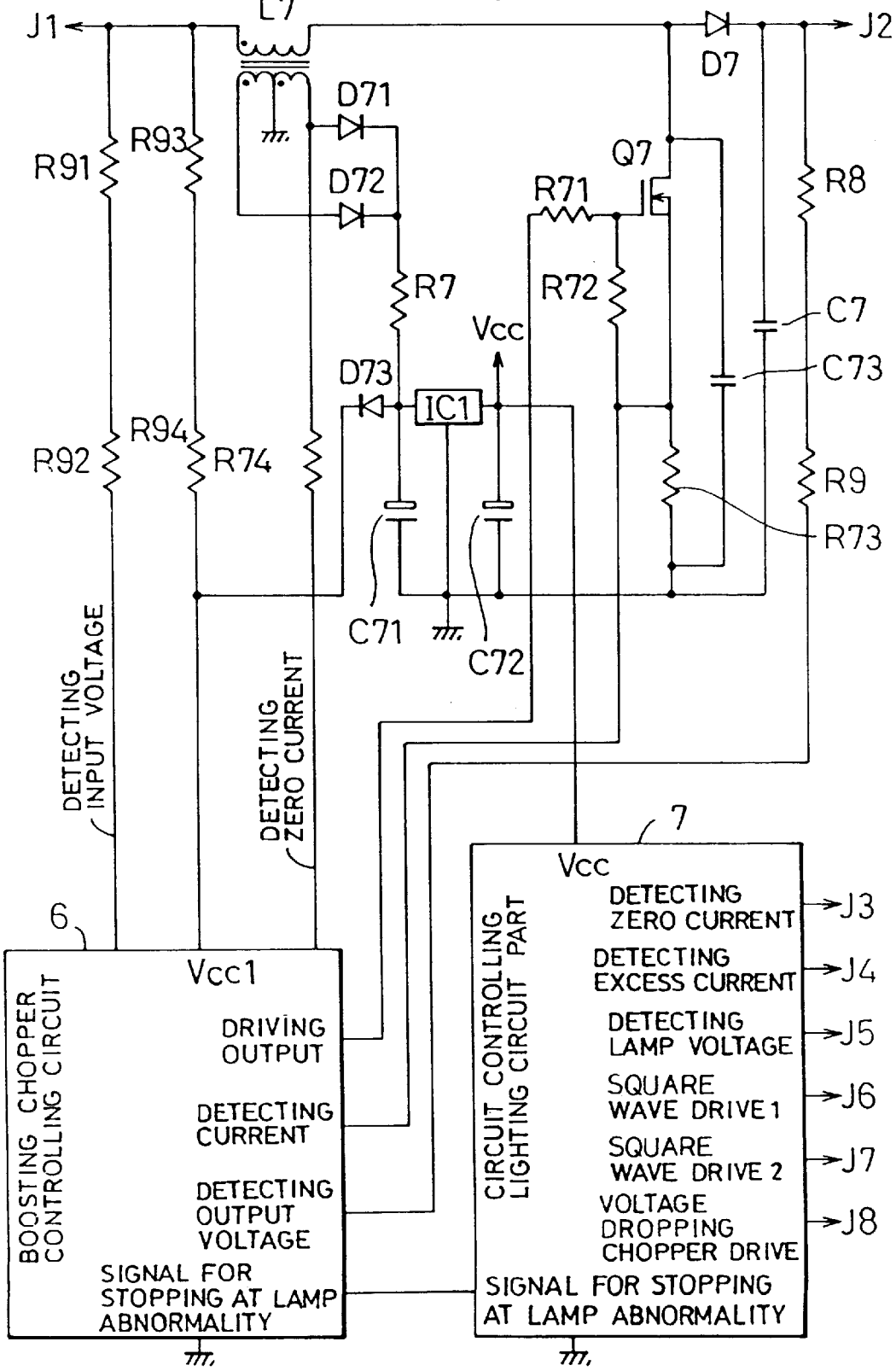
FIG. 12 is a circuit diagram of a power-factor improving section in a practical product of the discharge lamp lighting device embodying the present invention.
Figure 13:
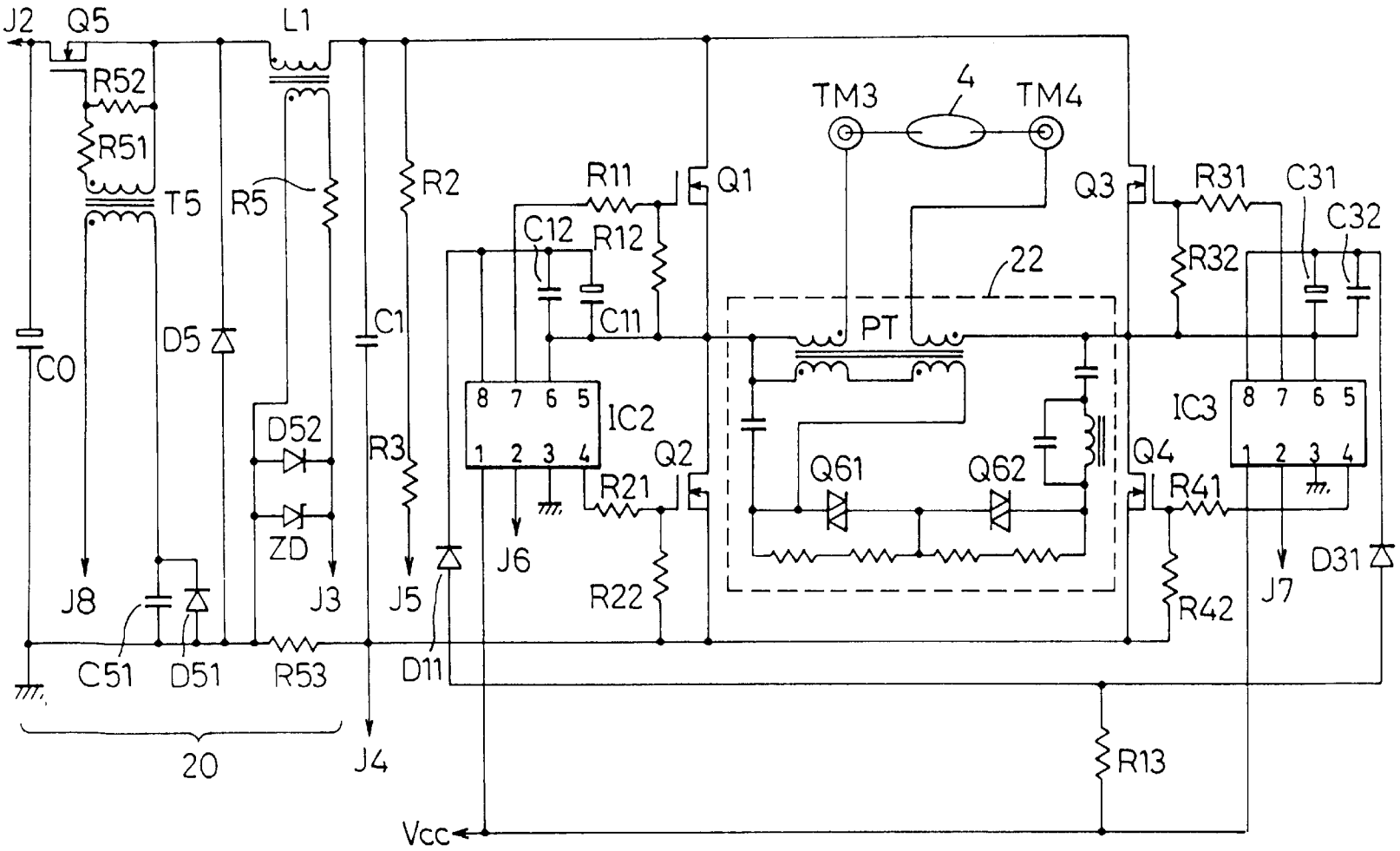
FIG. 13 is a circuit diagram of a lighting circuit section in a practical product of the discharge lamp lighting embodying the present invention.

In FIGS. 11 to 13, a lighting device embodying the present invention as a practical product is shown as an example, of which a source power input section is shown in FIG. 11, a power factor improving section is shown in FIG. 12, and a lighting circuit section is shown in FIG. 13, the respective sections being mutually connected at junctions J1–J8.

In the source power input section of FIG. 11, an Ac power source 1 connected to both terminals TM1 and TM2 of the section is connected, through a fuse FS, thermal protector TP, low resistor R4 and filter circuit, to AC input terminals of a rectifying circuit DB, and a capacitor C9 is connected across DC output terminals of this rectifying circuit DB. This capacitor C9 is of a small capacity, and a practical smoothing operation is performed by means of a boosting chopper circuit in the power-factor improving section at the later stage. The filter circuit includes a zinc oxide non-linear resistor (ZNR) for a surge voltage absorption, coils L5 and L6 and capacitors C5, C6, C8, C81 and C82, while a middle point of a series circuit of the capacitors C81 and C82 is connected through a capacitor C83 to a grounding terminal TM5.

The power factor improving circuit shown in FIG. 12 comprise a boosting chopper circuit including an inductor L7, switching element Q7 and diode D7, and is provided for receiving a full wave rectified output of the rectifying circuit DB from the junction J1 and for obtaining a boosted smooth DC voltage at an electrolytic capacitor C0 (FIG. 13) connected to a junction J2. The switching element Q7 of the boosting chopper circuit is connected through resistors R71 and R72 to a driving-output terminal of a boosting-chopper controling circuit 6, and its current is detected by means of a resistor R73. Further, a current flowing through the inductor L7 is detected through a resistor R74 connected to a secondary winding of the inductor L7. An output voltage produced at the junction J2 is detected through resistors R8 and R9, and an input voltage at the junction J1 is detected through resistors R91 and R92. An operating source power Vcc1 of the boosting chopper controling circuit 6 is supplied, upon connection to the power source, from the junction J1 through resistors R93 and R94 but, as the switching operation of the switching element Q7 starts, a secondary winding output of the inductor L7 is rectified by diodes D71 and D72 and a DC voltage thus obtained at a capacitor C71 through a resistor R7 is supplied through a diode D73 to the circuit 6. This DC voltage obtained at the capacitor C71 is rendered to be a constant voltage by means of a three-terminal type voltage regulator IC1 and is made to be an operating source power Vcc of a control circuit 7 for the lighting circuit section. This lighting circuit section control circuit 7 performs, through junctions J3–J5, a zero current detection, an excess current detection and a lamp voltage detection, and outputs, through junctions J6–J8, square wave drive signals and a voltage-dropping chopper drive signal.

The lighting circuit section shown in FIG. 13 is provided with a voltage-dropping chopper circuit section 20, which drops the DC voltage at the junction J2 obtained in the electrolytic capacitor C0 to an optional DC voltage through a switching element Q5, diode D5 and inductor L1, to obtain a lamp voltage at a capacitor C1, which voltage at the capacitor C1 is detected through resistors R2 and R3 and junction J5. Further, the current flowing through the inductor L1 is detected through a resistor R5 and the junction J3, and a current flowing to the voltage-dropping chopper circuit section 20 is detected from an end of a resistor R53 through the junction J4. The switching element Q5 in the voltage-dropping chopper circuit 20 is driven by the drive signal supplied to the junction J8 and through a transformer T5 and resistors R51 and R52.

Next, a polarity inverting circuit section comprises a full-bridge circuit of the four switching elements Q1 to Q4 which are respectively driven by means of general use driving circuits IC2 and IC3 and through resistors R11, R12; R21, R22; R31, R32; and R41, R42. The signals for square wave driving are connected through the junctions J6 and J7. As an operating source power for the driving circuits IC2 and IC3, the foregoing constant voltage Vcc is supplied. Further, capacitors C11, C12; and C31, C32 for driving the switching elements Q1 and Q3 on higher potential side are charged by this constant voltage Vcc supplied through a resistor R13 and diodes D11 and D31. A discharge lamp 4 is connected through a pulse transformer PT of an igniter circuit 22 to output ends of the full-bridge circuit, at terminals TM3 and TM4. The lamp 4 is either M98 (70W) or M130 (35W) of ANSI Standard, for example, and its light emitting tube is of ceramics. The igniter circuit 22 stops its pulse generation after the start of discharge of the lamp 4.

Now, in the present embodiment, the frequency of the square wave drive signals supplied from the control circuit 7 of the lighting circuit section through the junctions J6 and J7 to No. 2 pins of the driving circuits IC2 and IC3 is set to be low in the non-load state and for several seconds immediately after the start of discharge, and the setting is changed over to be high once a stable lighting state is reached. With the ON width of the switching element Q5 maintained in a wide state during the non-load for several seconds immediately after the start of discharge in which the discharge state is unstable, it is enabled to prevent the discharge lamp 4 from extinguishing and to improve the starting characteristic. It should be appreciated that the start of discharge of the lamp 4 can be detected in the form of a drop in the lamp voltage.

Embodiment 7

Figure 14:
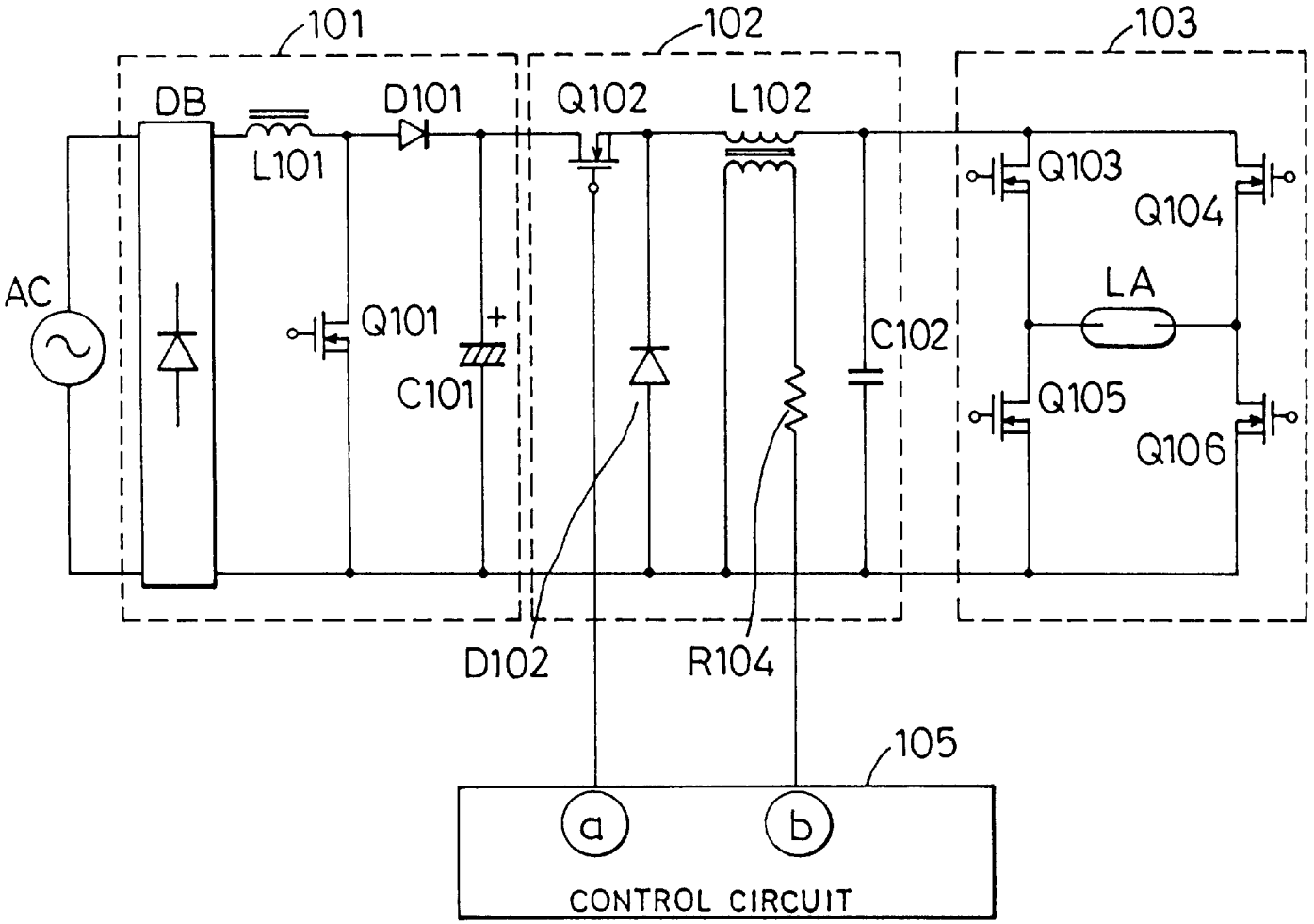
FIG. 14 is a circuit diagram showing a main circuit arrangement of the device in another embodiment of the present invention.
Figure 16:
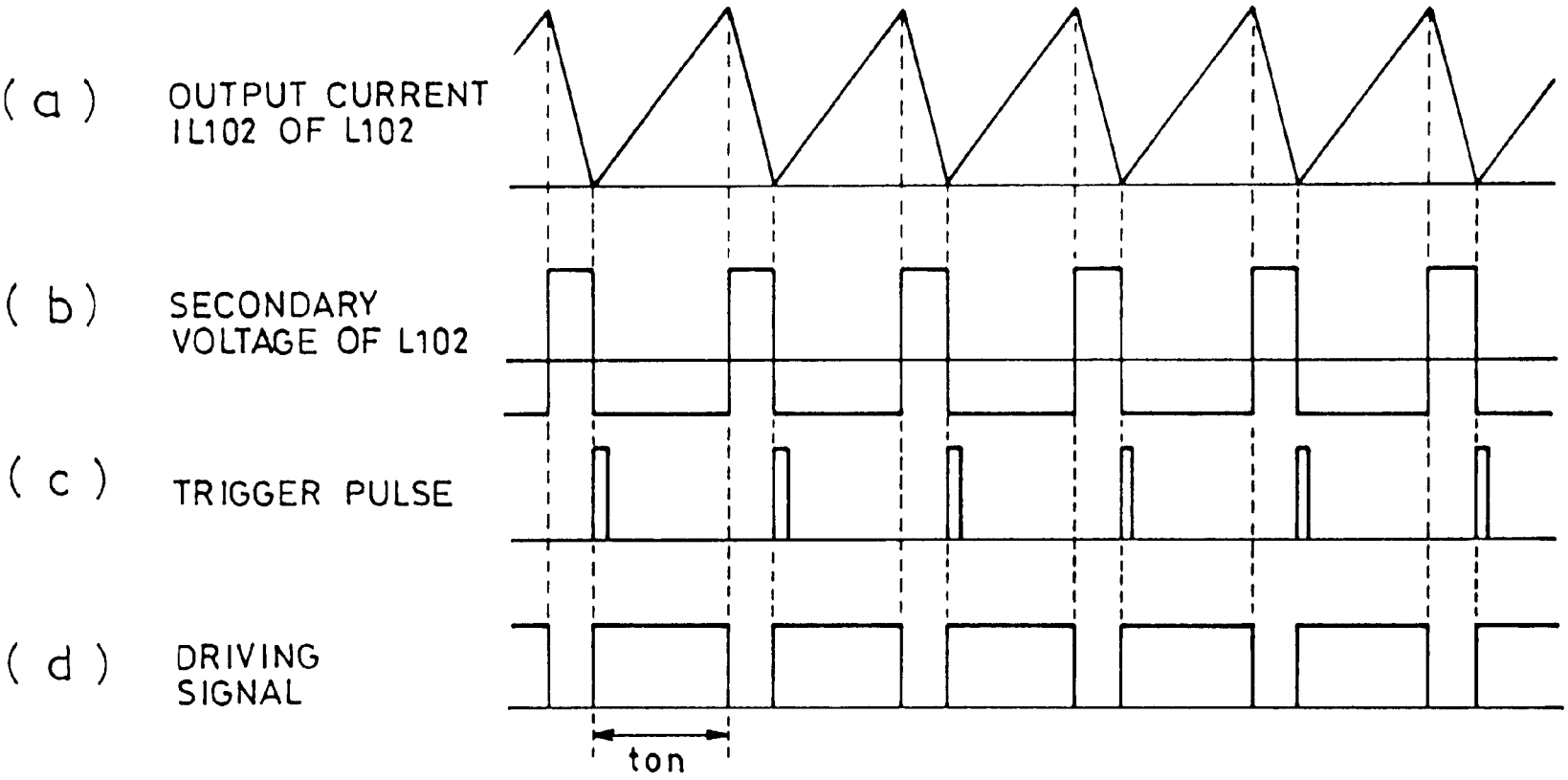
FIG. 16 is a waveform diagram showing the operation of a zero current detecting circuit in the embodiment of FIG. 14.

In FIG. 14, a circuit arrangement of a seventh embodiment of the present invention is shown, which generally comprises a voltage boosting chopper circuit 101 forming a DC power source circuit, a voltage dropping chopper circuit 102, a polarity inverting circuit 103, and a control circuit 105 for a drive control of a switching element Q102 in the voltage dropping chopper circuit 102. The DC power source circuit 101 is to convert a pulsating voltage obtained by full-wave rectifying a power from a commercial AC power source AC by means of the full-wave rectifier DB into a DC voltage by means of a so-called voltage boosting chopper circuit 101 comprising an inductor L101, diode D101, capacitor C101 and such switching element Q101 as a MOSFET. The voltage dropping chopper circuit 102 is constituted by such switching element Q102 as the MOSFET which turns ON and OFF at several ten kHZ, diode D102 and inductor L102, and a current IL102 flowing through the inductor L102 is rendered to be such triangular wave form as shown in FIG. 16(*a*) and is detected through a resistor R104 connected in series to a secondary winding of the inductor L102. Detection output of this current IL102 is provided to the control circuit 105 and is made to be a feedback signal for controlling zero-cross switching drive of the switching element Q102 in the voltage dropping chopper circuit 102 through the control circuit 105. Further, the capacitor C102 is to remove a high frequency component from an output current of the voltage dropping chopper circuit 102. The polarity inverting circuit 103 constitutes a square wave inverting which converts a DC output from the former-stage voltage dropping choppr circuit 102 into a square power of a low frequency and alternating at several hundred Hz by means of a full-bridge circuit of such switching elements Q103–Q106 as MOSFET, and supplies a square wave current of a low frequency to a high pressure discharge lamp LA.

Figure 15:
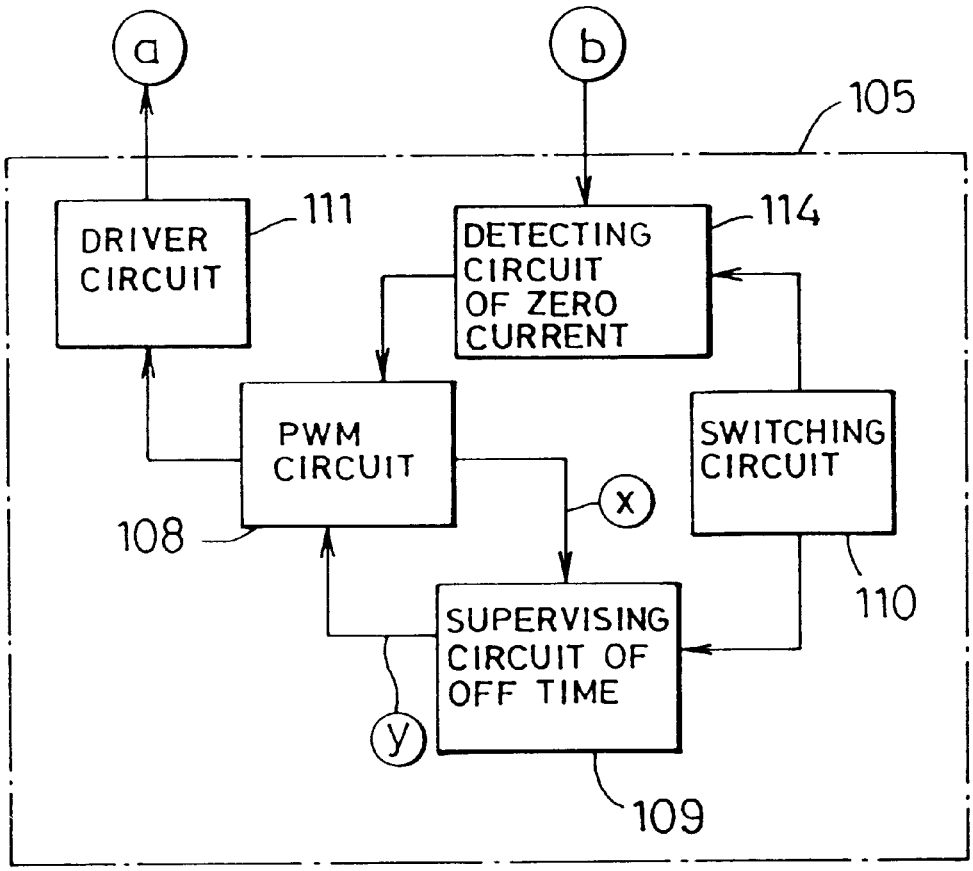
FIG. 15 is a circuit diagram showing a control circuit in the device of the embodiment shown in FIG. 14.

Details of the control circuit 105 for the drive-control of the switching element Q102 is shown in FIG. 15, in which the control circuit 15 comprises a zero current detecting circuit 114 for detecting a secondary voltage of the inductor L102 in the voltage dropping chopper circuit 102, a PWM circuit 108 for determining a signal duty for driving the switching element Q102 of the voltage dropping chopper circuit 102 and outputting signals for switching over the switching element Q102 of the circuit 102, an OFF-time supervising circuit 109 which outputs a signal in an event when the switching element Q102 of the circuit 102 is not switched over for more than a fixed time, a switching circuit 110 for switching over between the zero current detecting circuit 114 and the OFF-time supervising circuit 109, and a driver circuit 111 for outputting a driving signal.

Figure 19:
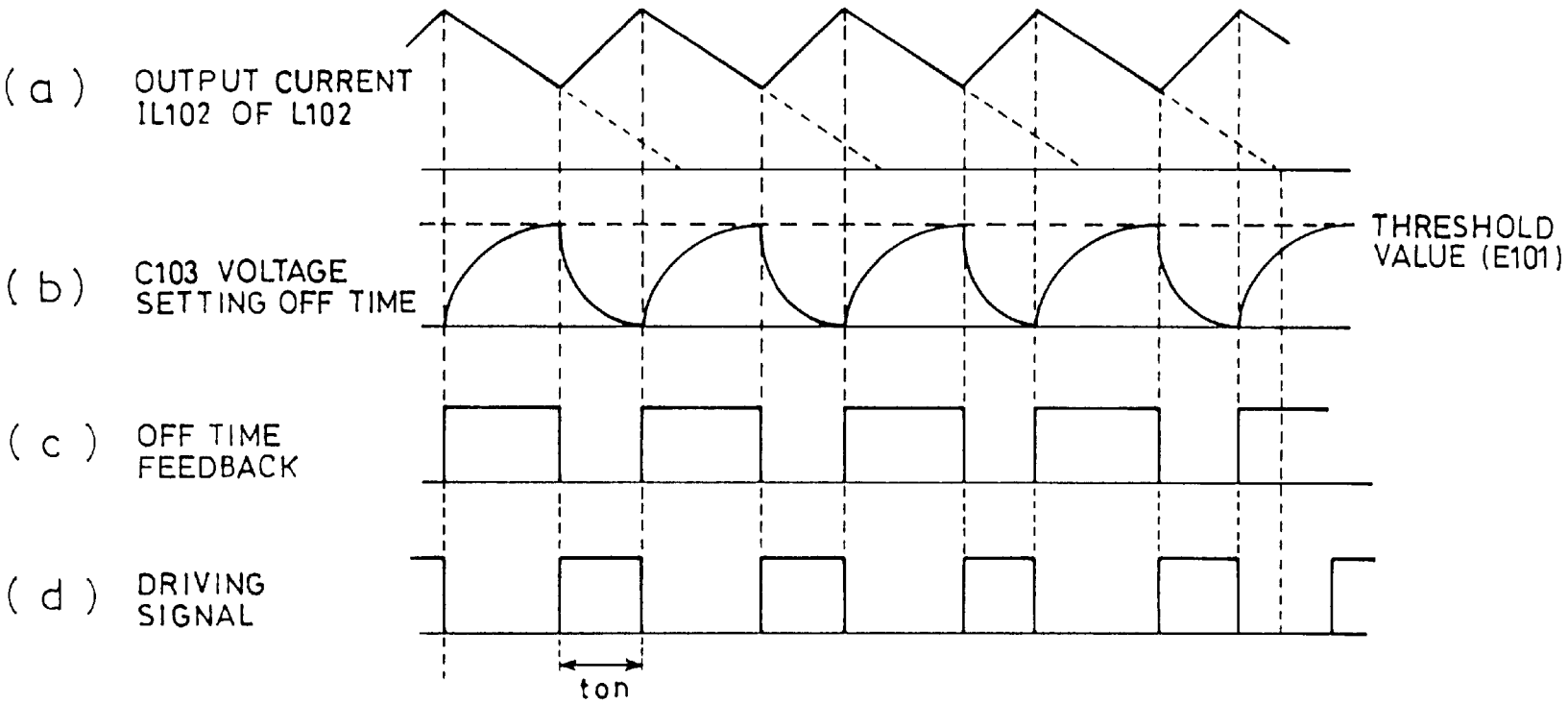
FIG. 19 shows waveform diagrams for explaining the operation of the OFF time supervising circuit in FIG. 18 of the present invention.

In the present embodiment, the switching circuit 110 actuates the OFF-time supervising circuit 109 when the discharge lamp voltage is below a certain discharge lamp voltage value Va which is smaller than the largest discharge lamp voltage (FIG. 17), the current IL102 flowing to the inductor L102 is caused to be sequentially switched over as in FIG. 19(*a*), and the lamp can be prevented from extinguishing while the lamp is maintained until its stable lighting.

Figure 18:
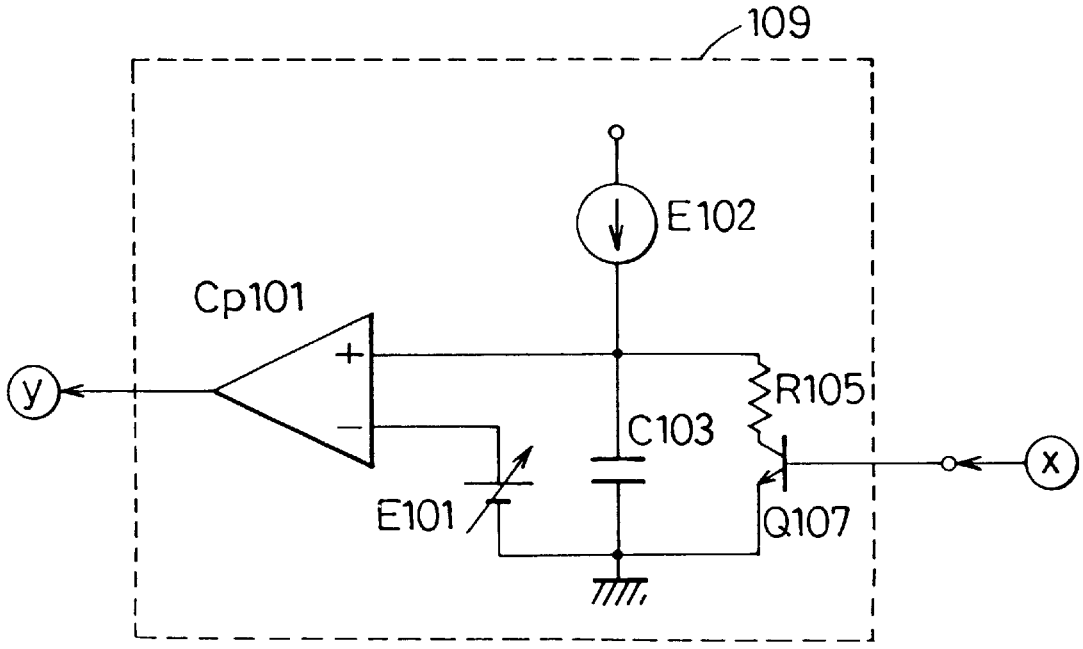
FIG. 18 is a circuit diagram showing an arrangement of an OFF time supervising circuit in the embodiment of FIG. 14 of the present invention.
Figure 20:
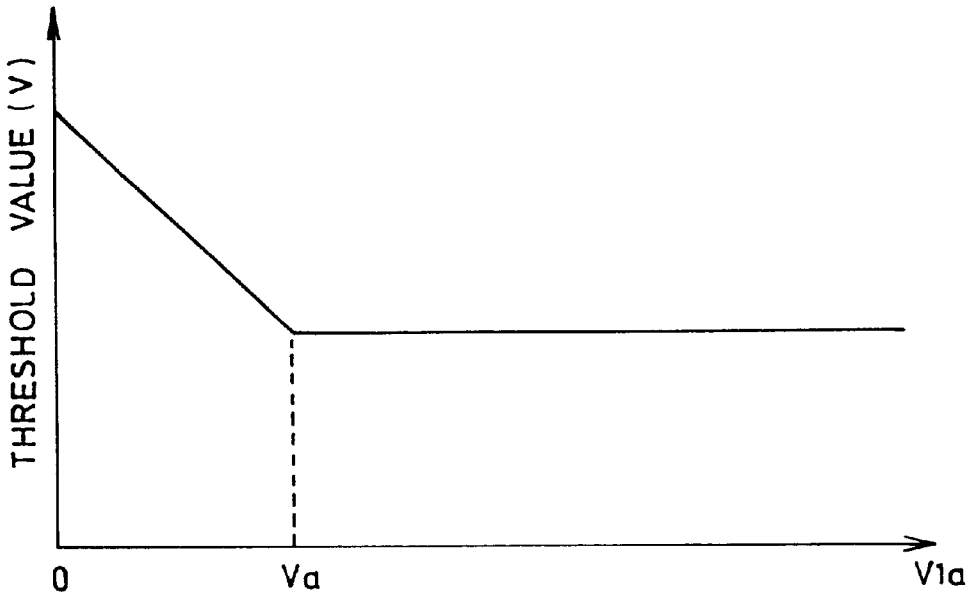
FIG. 20 is an explanatory view showing the relationship between a threshold value voltage and a discharge lamp voltage in the embodiment of FIG. 14.

Here, an internal circuit of the OFF-time supervising circuit 109 is shown in FIG. 18, and this circuit 109 comprises a variable threshold voltage E101, a capacitor C103, a comparator Cp101, a constant current source E102, a resistor R105 for discharging the capacitor C103 and such switching element Q107 as a transistor. The threshold voltage E101 will be a voltage which linearly decreases when the lamp voltage is smaller than the foregoing lamp voltage value Va but will be a constant threshold voltage when the lamp voltage is above the value Va. The relationship between the threshold voltage E101 and the lamp voltage V1a is shown in FIG. 20. When a charge voltage of the capacitor C103 (FIG. 19(*b*)) is below this threshold voltage E101, no driving signal (FIG. 19(*d*)) is provided to the switching element Q102 in the voltage dropping chopper circuit 102. With this OFF-time supervising circuit 109, the current IL102 flowing to the inductor L102 can be sequentially switched over as in FIG. 19(*a*). As the charge voltage of the capacitor C103 reaches the threshold voltage E101, the comparator Cp101 provides a "High" level signal to the PWM circuit 108. At this time, a signal "x" for turning the switching element Q107 ON is provided from the PWM circuit 108 as the feedback signal, a charge in the capacitor C103 is drawn out, and the driving signal (the "High" level signal of FIG. 19(*d*)) is provided from the driver circuit 111 to the switching element Q102 of the voltage dropping chopper circuit 102. The capacitor C103 is kept in short-circuit state until the output of the PWM circuit 108 becomes the "Low" level next time.

Figure 17:
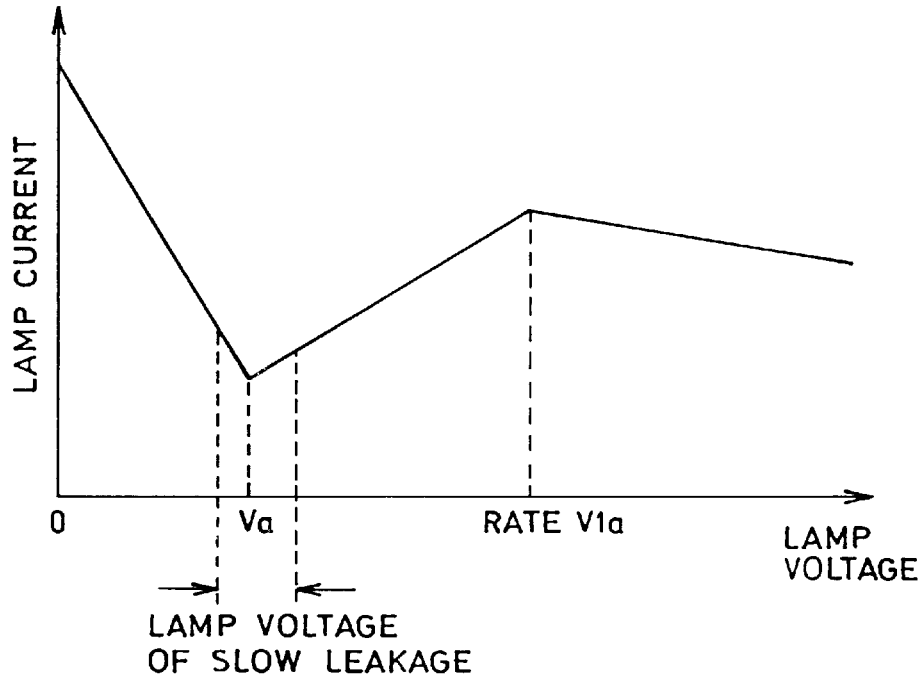
FIG. 17 is an explanatory diagram showing circuitry characteristics of the device in another embodiment of the present invention.

Next, as the lamp voltage becomes above the predetermined value Va of FIG. 17, the switching circuit 110 actuates the zero current detecting circuit 114 to have the current IL102 flowing to the inductor L102 subjected to a discontinuous zero-cross switching, and the lamp is lighted with a desired lamp power. The zero current detecting circuit 114 detects a secondary winding voltage (FIG. 16(*b*)) of the inductor L101 in the voltage dropping chopper circuit 102, so that a fall of the secondary winding voltage of the inductor L102 occurring when the current IL102 of the inductor L102 in the voltage dropping chopper circuit 102 becomes zero will be detected, and a trigger pulse (FIG. 16(*c*)) is provided to the PWM circuit 108. Upon receipt of such trigger pulse from the zero current detecting circuit 114, the PWM circuit 108 provides a "Low" level signal after maintaining the "High" level output state for a fixed time, and this "Low" level signal is transmitted by the driver circuit 111 to the switching element Q102 of the voltage dropping chopper circuit 102 as a driving signal (FIG. 16(*d*)).

Embodiment 8

The present eighth embodiment is of the same circuit arrangement as in the foregoing Embodiment 7 (FIG. 14), and the control circuit 105 corresponding to the switching element Q102 of the voltage dropping chopper circuit 102 is also of the same arrangement. While in Embodiment 7 the OFF-time supervising circuit 109 causes the switching element Q102 to perform the continuous switching from immediately after the start of lighting of the discharge lamp and the operation is changed over to that of the zero current detecting circuit 114 at the predetermined value Va of the lamp voltage until at least the discharge lamp power reaches a rated level so that the switching element Q102 will be switched to cause the current IL102 flowing to the inductor L102 to perform the discontinuous switching, the predetermined voltage Va at which the OFF-time supervising circuit 109 is changed over to the zero current detecting circuit 104 is set in the present embodiment to be in range of 30 to 50% of the rated discharge lamp voltage (when the rated voltage is 90V, for example, the range will be about 25 to 45V) in which a slow leakage as one of lamp accident modes occurs (a phenomenon in which the lamp voltage is lowered by the leakage of gas in the light emitting tube and an excess current is caused to be kept flowing to the lamp).

Embodiment 9

Figure 21:
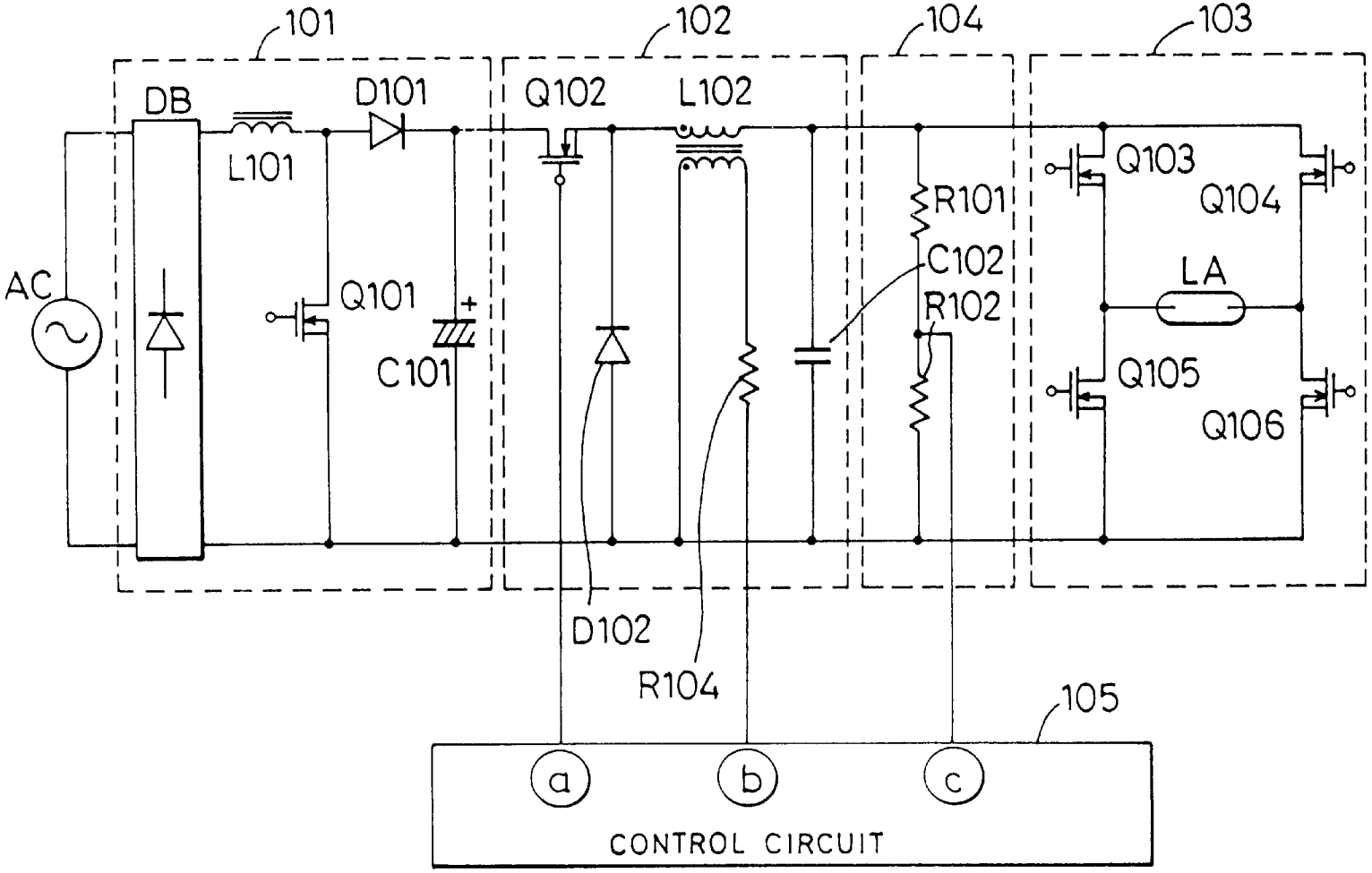
FIG. 21 is a circuit diagram showing the device in another embodiment of the present invention.
Figure 22:
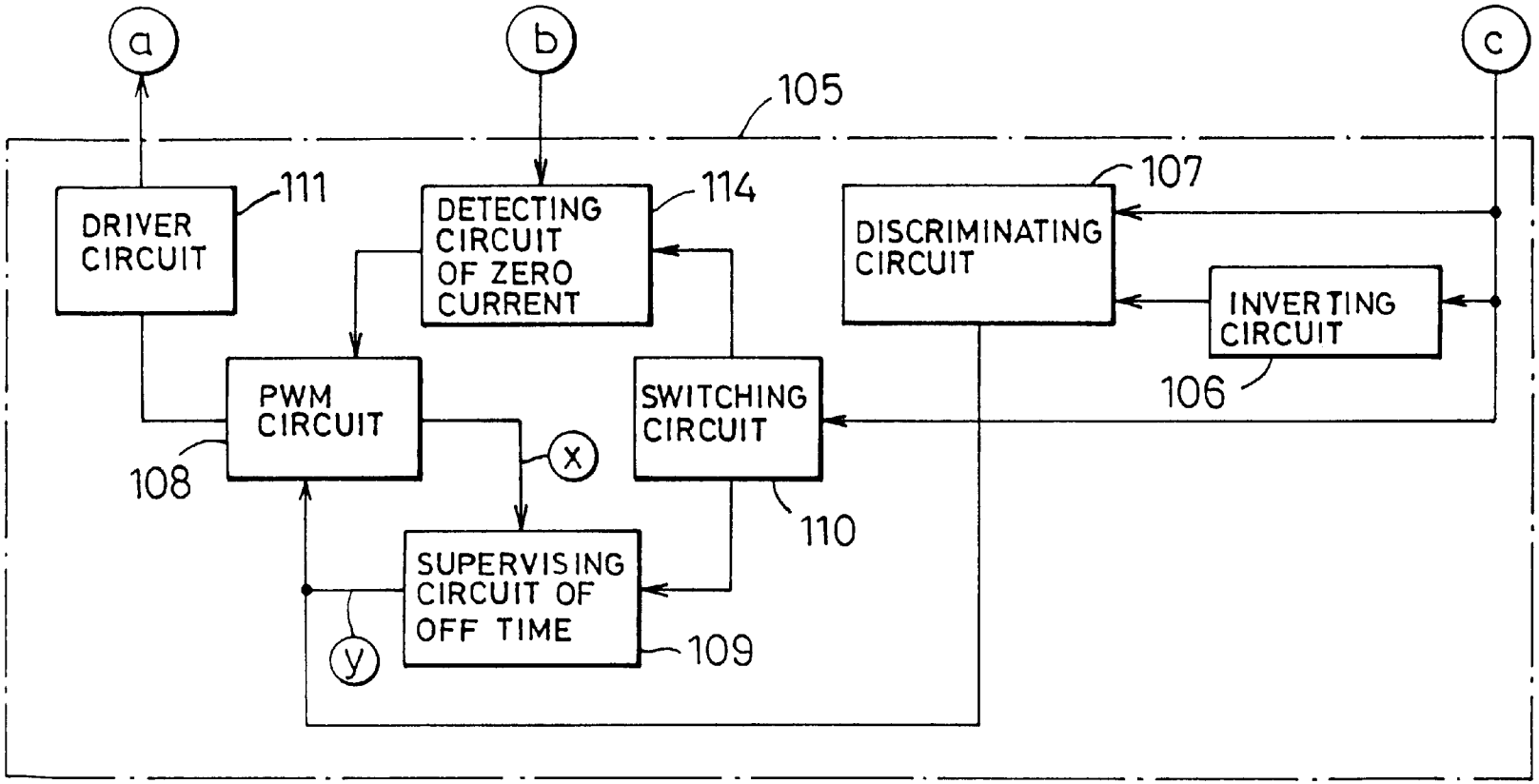
FIG. 22 is a circuit diagram of a control circuit in the embodiment of FIG. 21.
Figure 23:
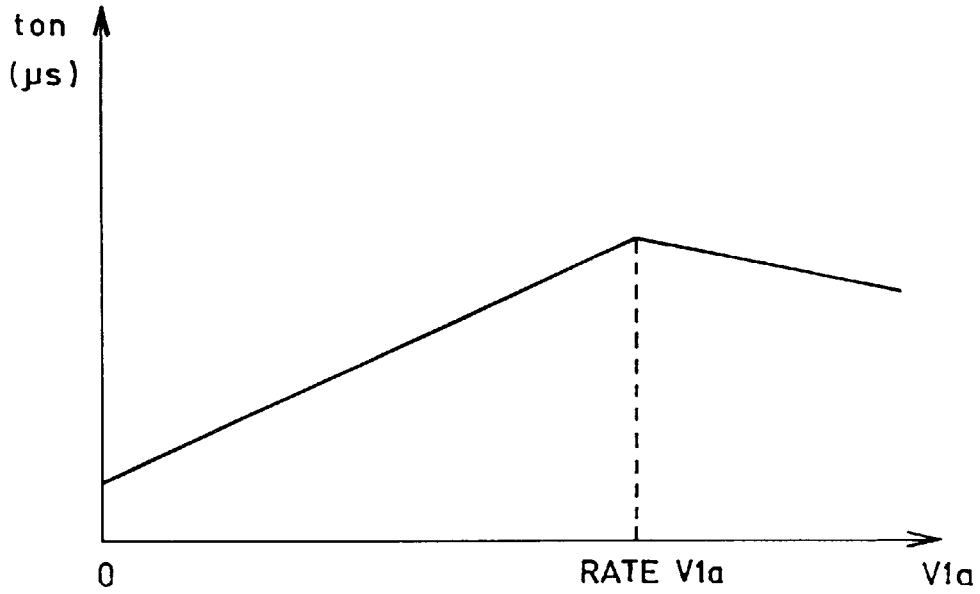
FIG. 23 is an explanatory view for control characteristics of ON width in the embodiment of FIG. 21.

FIG. 21 shows a circuit arrangement of Embodiment 9 of the present invention, in which a discharge lamp voltage detecting circuit 104 is added to the circuit of FIG. 14, while the control circuit 105 has such arrangement as shown in FIG. 22. The discharge lamp voltage detecting circuit 104 detects the lamp voltage of the high pressure discharge lamp LA by means of a series circuit of resistors R101 and R102 connected in parallel with the source power input ends of the polarity inverting circuit 103, and thus detected lamp voltage V1a101 is provided to the control circuit 105 as a feedback signal for the drive-control of the switching element Q102 of the voltage dropping chopper circuit 102 through the control circuit 105. With the provision of this discharge lamp voltage detecting circuit 104, the OFF-time supervising circuit 109 is changed over to the zero current detecting circuit 114 once the lamp voltage has reached the predetermined value Va, and the value of the lamp voltage is made to correspond to the ON width ton (ON duty) of the switching element Q102 of the voltage dropping chopper circuit 102 (FIG. 23).

Figure 24:
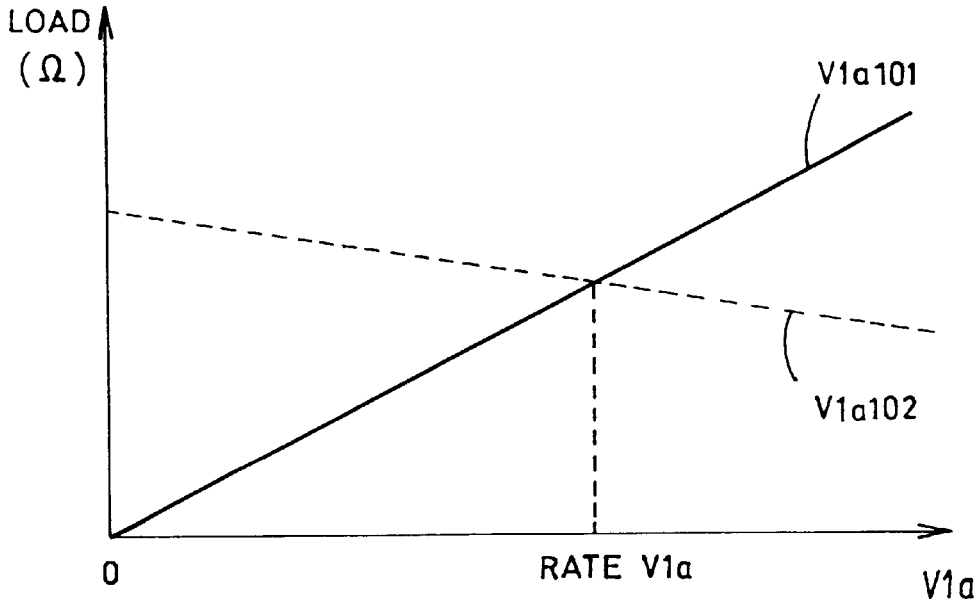
FIG. 24 is an explanatory view for the operation of an inverting circuit in the embodiment of FIG. 21.

In the control circuit 105, an inverting circuit 106 for inverting the detected value of the lamp voltage as well as a discriminating circuit 107 for comparing the detected value of the lamp voltage with its inverted value to utilize a lower one of these values, are additionally provided. In FIG. 24, a solid line represents the detected value V1a101 obtained by voltage-dividing the lamp voltage, and a dotted line represents the inverted value V1a102 of the detected value V1a101 of the lamp voltage. This dotted line may be varied in the gradient. The discriminating circuit 107 selects the lower one of the detected value V1a101 and the inverted value V1a102, and the selected lower value is output to the PWM circuit 108. This lamp voltage obtained through the comparison will be a threshold voltage of the PWM circuit 108, and the ON width ton (ON duty) of the switching element Q102 of the voltage dropping chopper circuit 102 is determined as shown in FIG. 23. With such provision of the discharge lamp voltage detecting circuit 104, the OFF-time supervising circuit 109 can be changed over to the zero current detecting circuit 114 when the lamp voltage reaches the predetermined value Va and, after the change over, the ON width of the switching element Q102 of the voltage dropping chopper circuit 102 can be controlled in accordance with the value of the lamp voltage.

Embodiment 10

Figure 25:
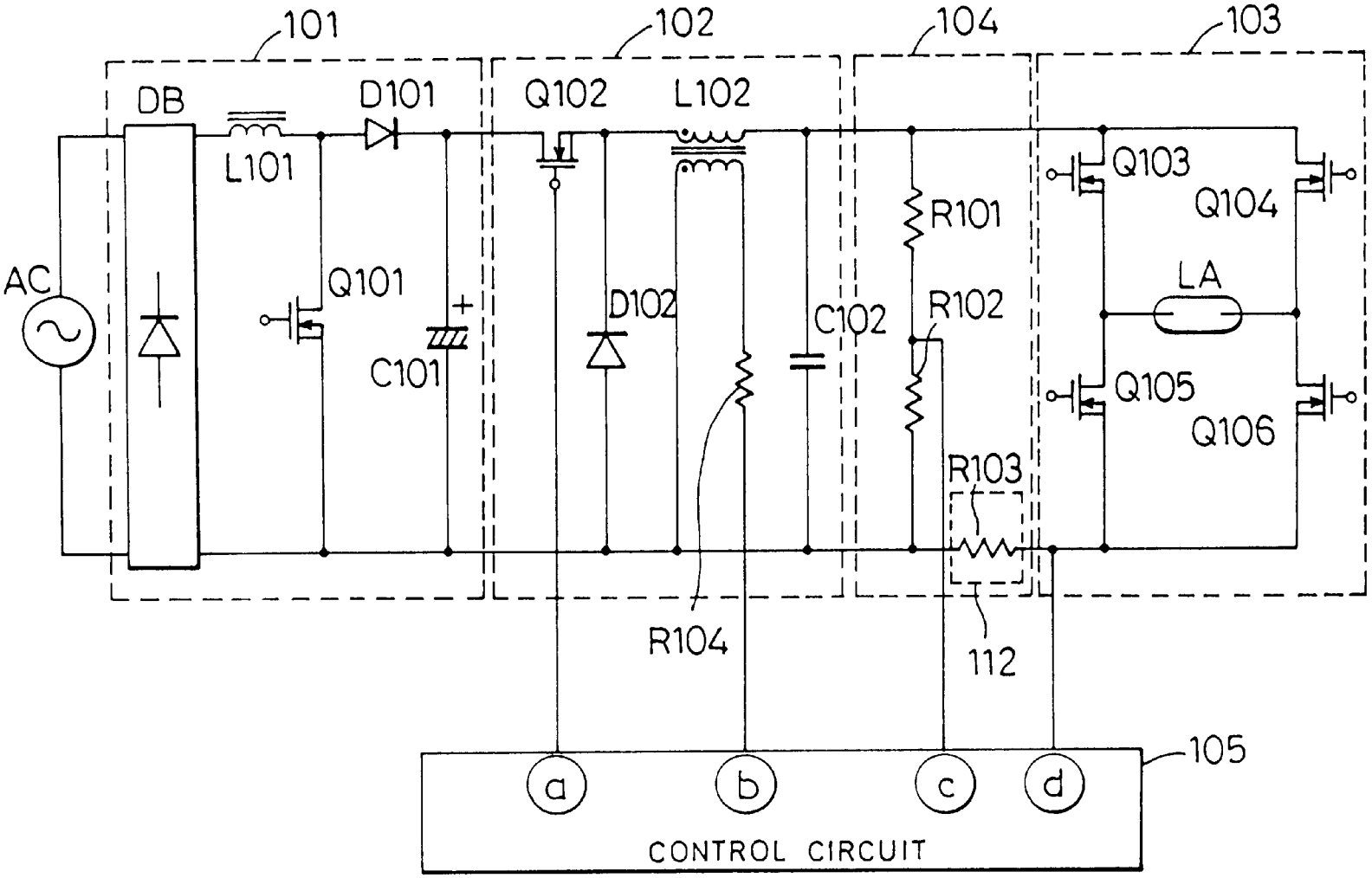
FIG. 25 is a circuit diagram showing another embodiment of the present invention.
Figure 26:
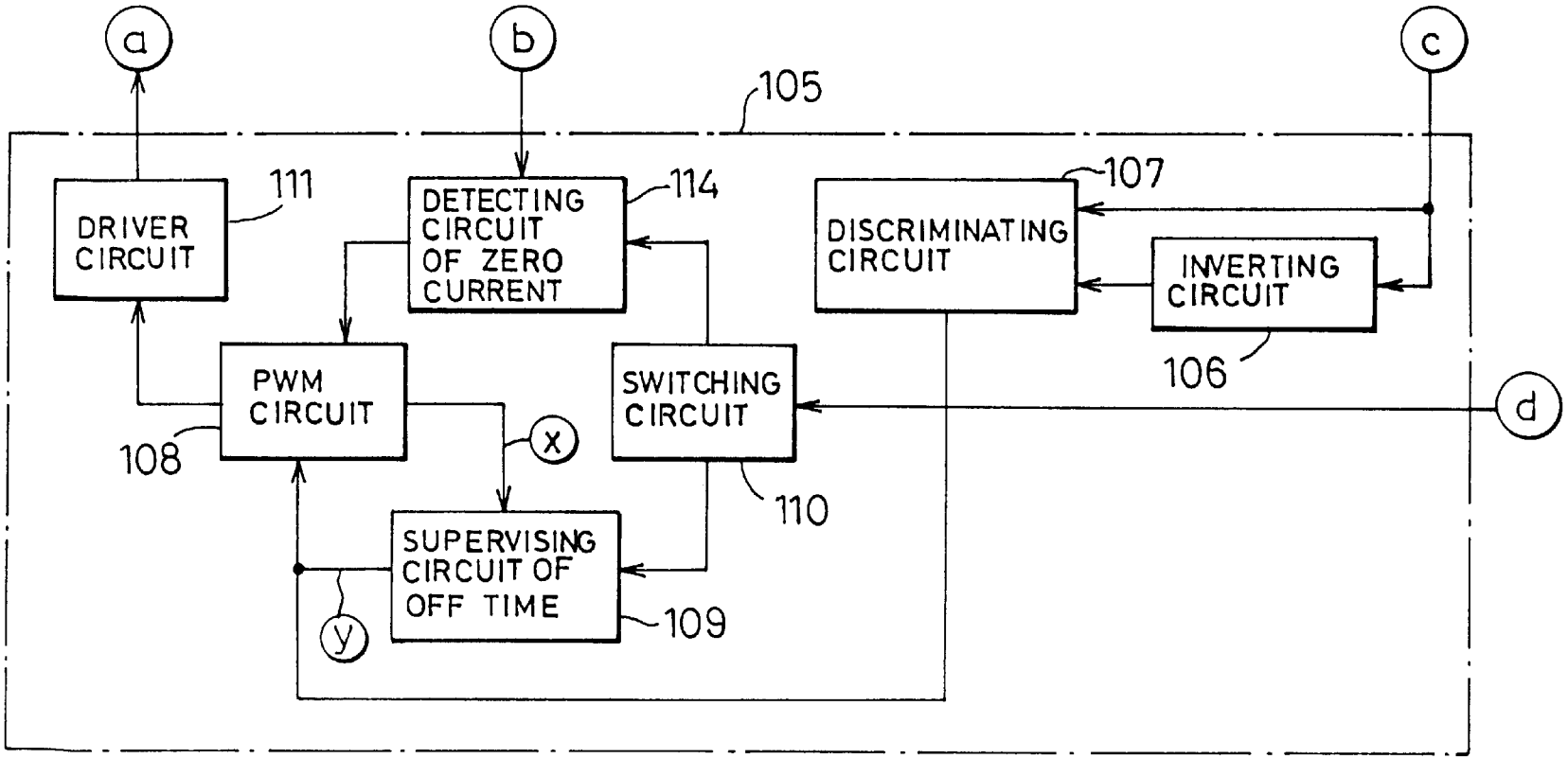
FIG. 26 is a circuit diagram of a control circuit in the embodiment of FIG. 25.

In FIG. 25, a circuit arrangement of Embodiment 10 according to the present invention is shown, in which a discharge lamp current detecting circuit 112 is added so that, as the discharge lamp current value is detected to have reached a predetermined value, the OFF-time supervising circuit 109 is changed over to the zero current detecting circuit 114. Further, the control circuit 105 here is arranged as shown in FIG. 26. The discharge lamp current detecting circuit 112 detects the lamp current of the high pressure discharge lamp LA by means of a resistor R103 connected in series with the source power input end of the polarity inverting circuit 103, and thus detected value I1a101 is provided to the control circuit 105, in which the switching circuit 110 changes the OFF-time supervising circuit 109 over to the zero current detecting circuit 114. Other respects in the circuit arrangement are the same as those in Embodiment 9 and their description shall be omitted here.

Embodiment 11

Figure 27:
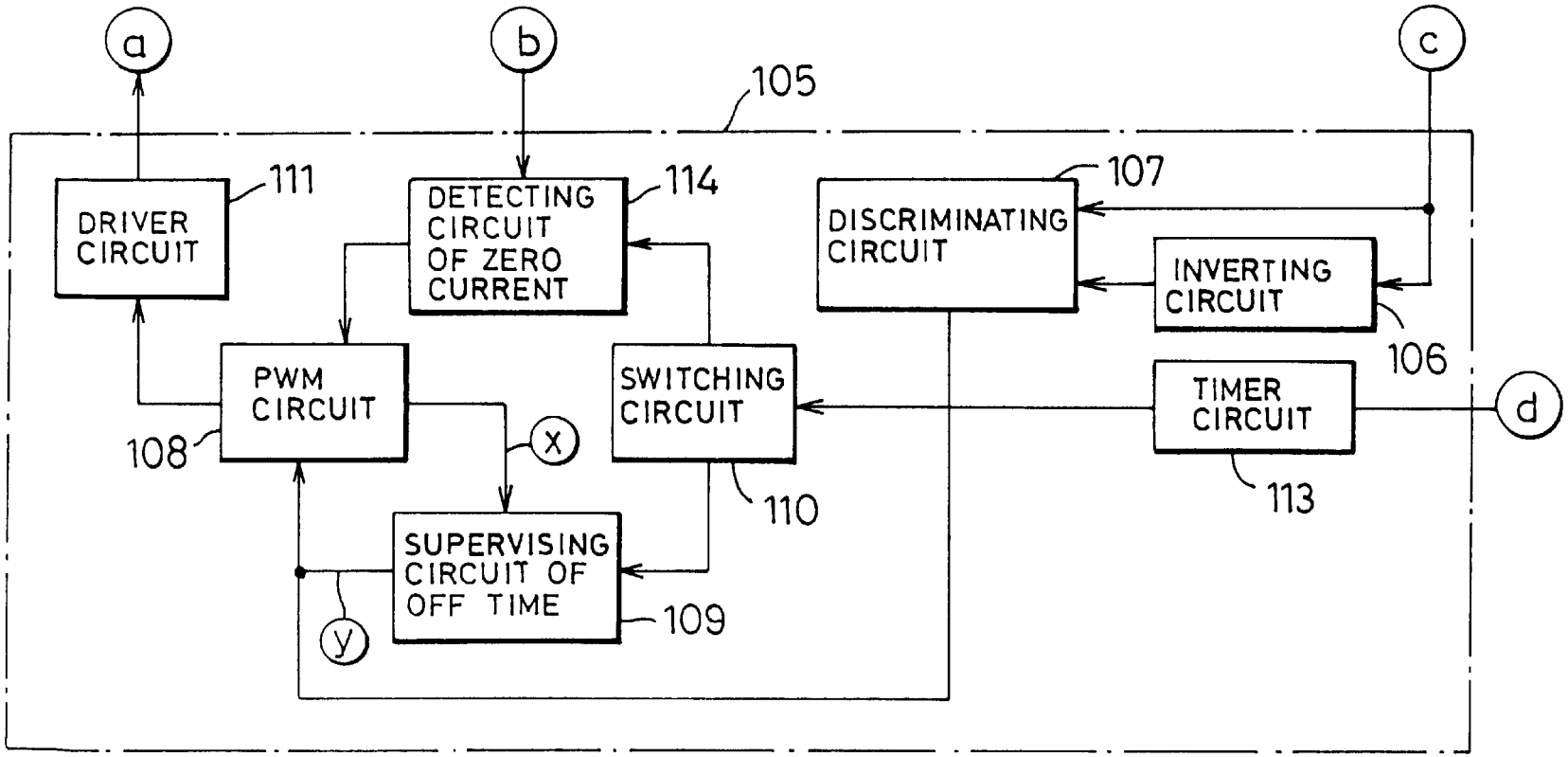
FIG. 27 is a circuit diagram of a control circuit in another embodiment of the present invention.

FIG. 27 shows a circuit arrangement of the control circuit 105 in Embodiment 11 of the present invention. While the main circuit arrangement of this embodiment is the same as that in FIG. 25, the control circuit 105 is different in an additional provision of a timer circuit 113. When the lamp current is detected by the discharge lamp current detecting circuit 104, the timer circuit 113 starts an integration of time. Since the time from the start to a rated discharge lamp voltage reached is substantially fixed, the time constant of the timer circuit 113 is made to be in conformity to the time until the predetermined value Va of the lamp voltage is reached. When this time for reaching the value Va is over, the switching circuit 110 changes the OFF-time supervising circuit 109 over to the zero current detecting circuit 114.

Embodiment 12

FIG. 17 is also an explanatory view for Embodiment 12, wherein a duty width of ON signal provided from the driver circuit 111 in a low lamp voltage range in which a damage due to such multicurrent as the slow leakage in Embodiment 7 is likely to occur is set to be narrow, so that the circuit characteristic of less lamp current in the low lamp voltage range can be obtained, as shown in FIG. 17.

Embodiment 13

Similarly, in Embodiment 8, the risk due to the multicurrent at the time of slow leakage can be reliably eliminated as shown in FIG. 17, by setting to be smaller than usual the ON width of the driving signal output from the driver circuit 111 under the control of the zero current detecting circuit 114 to which the operation has been changed over at the predetermined lamp voltage value Va in the abnormal state of the lamp including the slow leakage.

Figure 28:
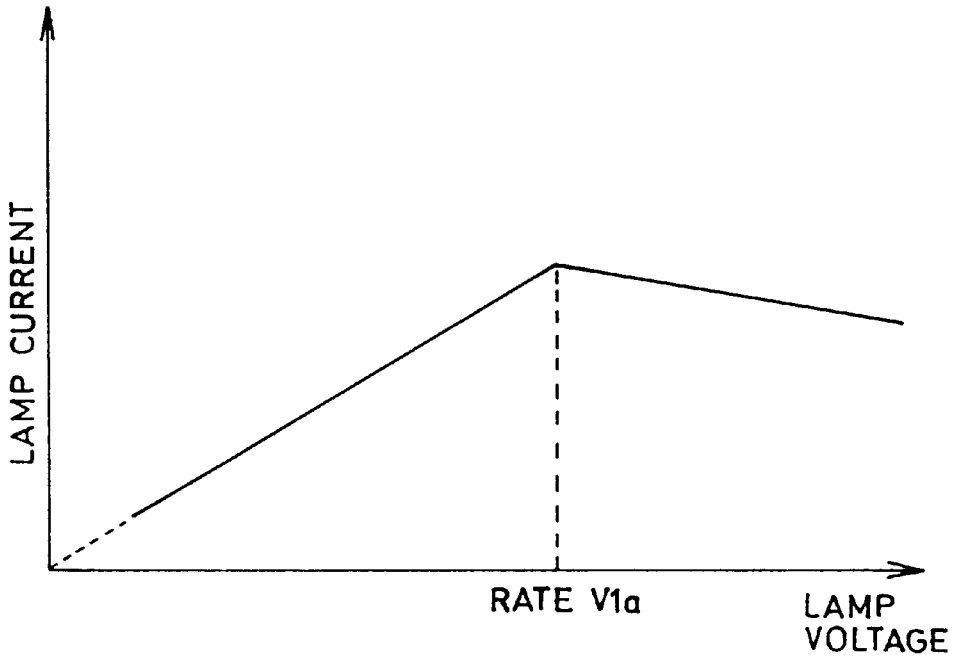
FIG. 28 is an explanatory view for circuit characteristics in an event when the OFF time supervising circuit is not operated in the device of the present invention.

In FIG. 28, a circuit characteristic relying only on such ON width control as shown in FIG. 23 in which the OFF-time supervising circuit 109 is not operated, is shown as a comparative example. In the present embodiment, the zero current detecting circuit 114 and OFF-time supervising circuit 109 are changed over at the predetermined value Va in the low voltage range in which the slow leakage is likely to occur, and the ON width of the driving signal is set to be smaller in the low voltage range.

While in the foregoing embodiments the discharge lamp lighting device has been referred to only partly and details of the whole circuit arrangement have not been described, an example of their application to a practical discharge lamp lighting device will be as in the followings.

Embodiment 14

Figure 29:
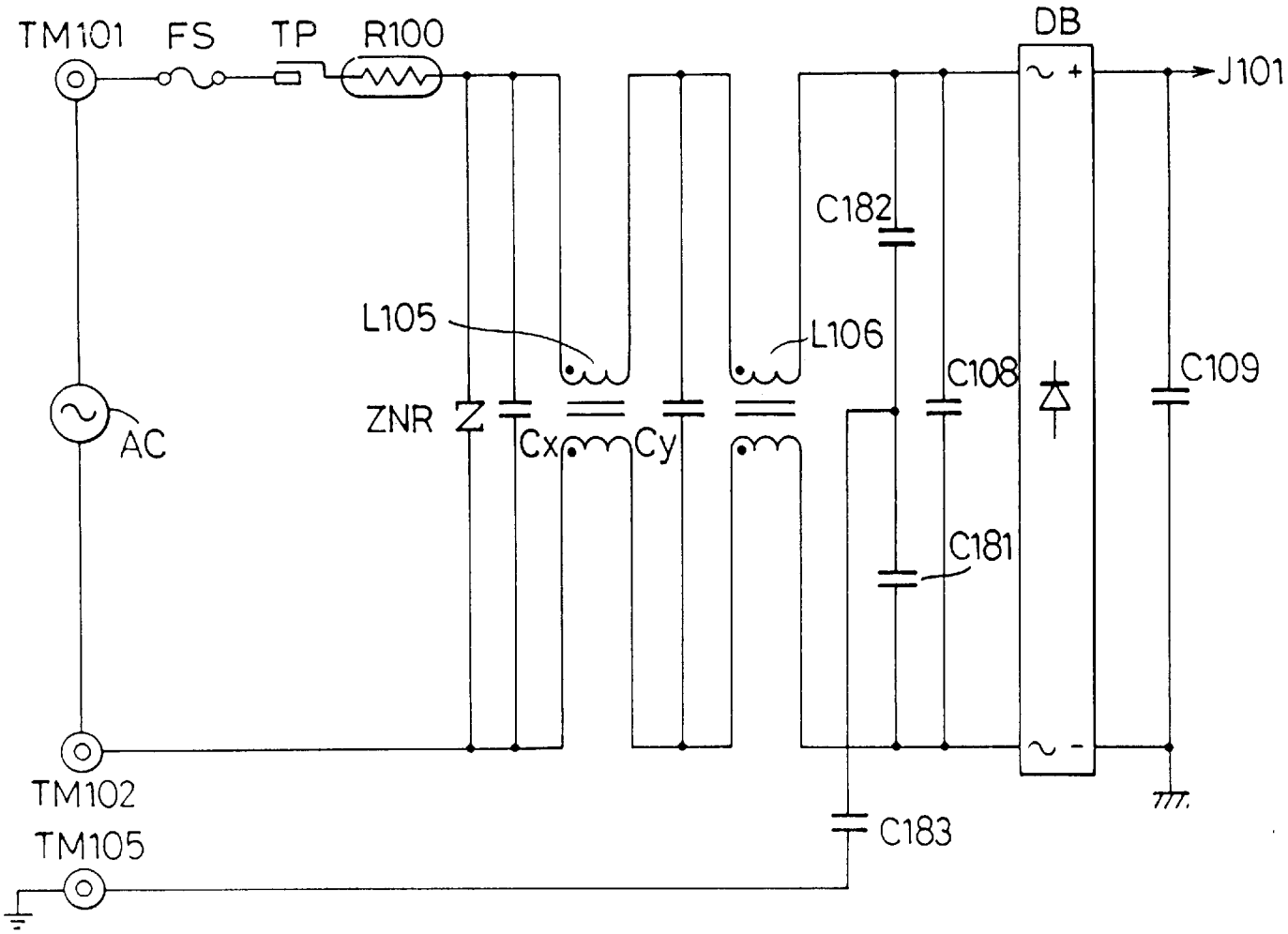
FIG. 29 is a circuit diagram of a source power input section in a practical product of the discharge lamp lighting device embodying the present invention.
Figure 30:
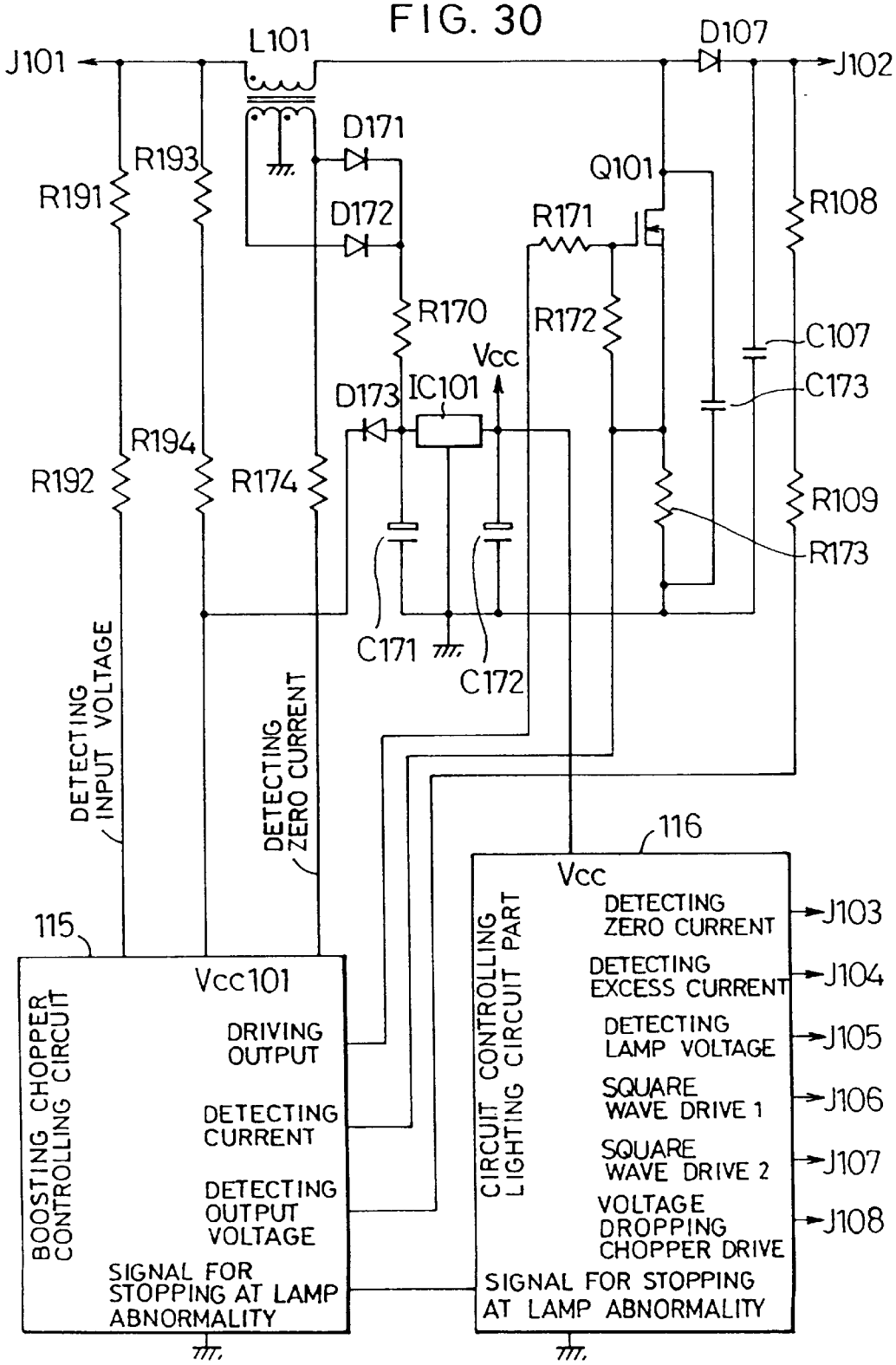
FIG. 30 is a circuit diagram of a power-factor improving section in the discharge lamp lighting device embodying the present invention.
Figure 31:
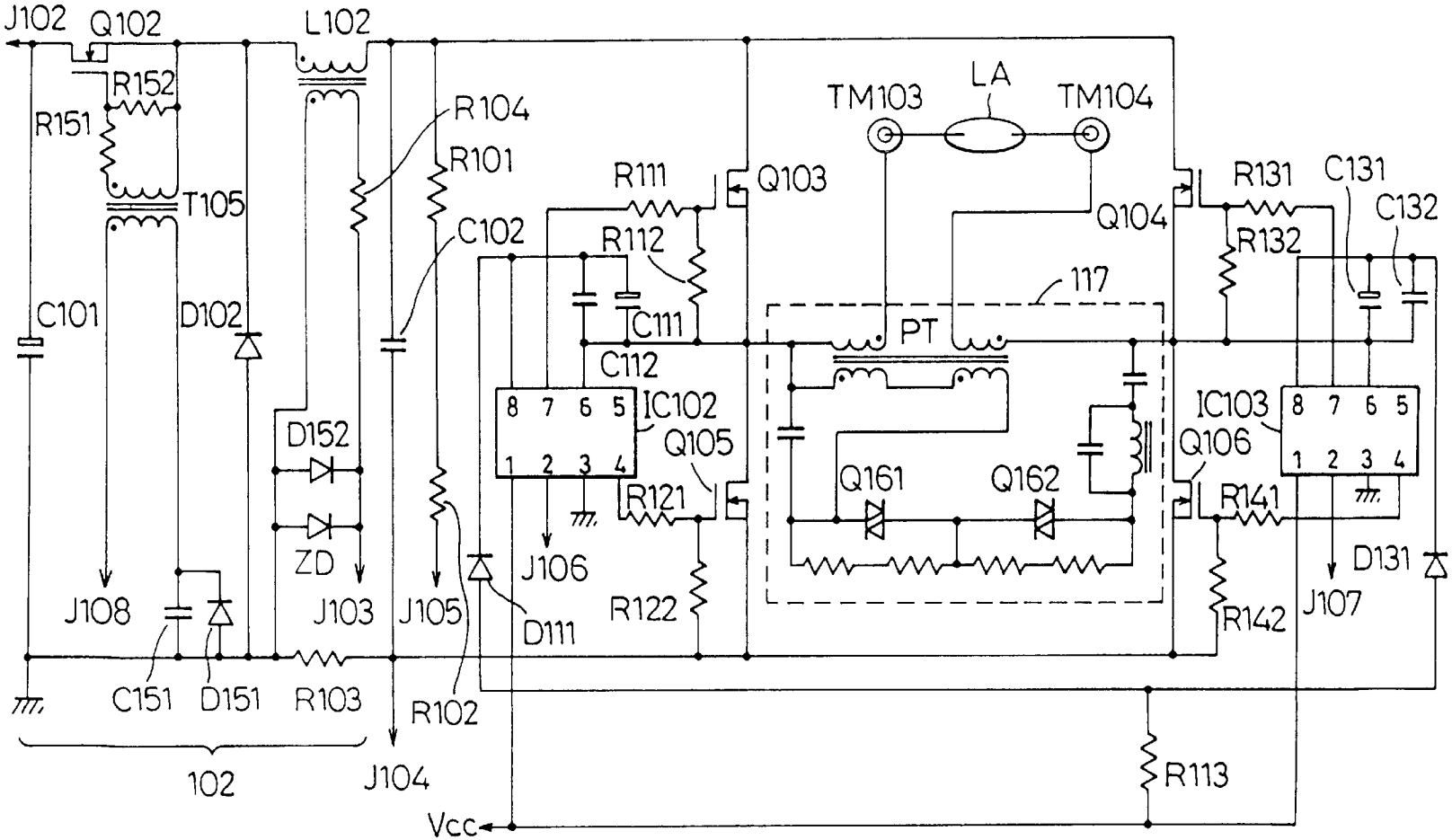
FIG. 31 is a circuit diagram of a lighting circuit section in a practical product of the discharge lamp lighting device embodying the present invention.
Figure 32:
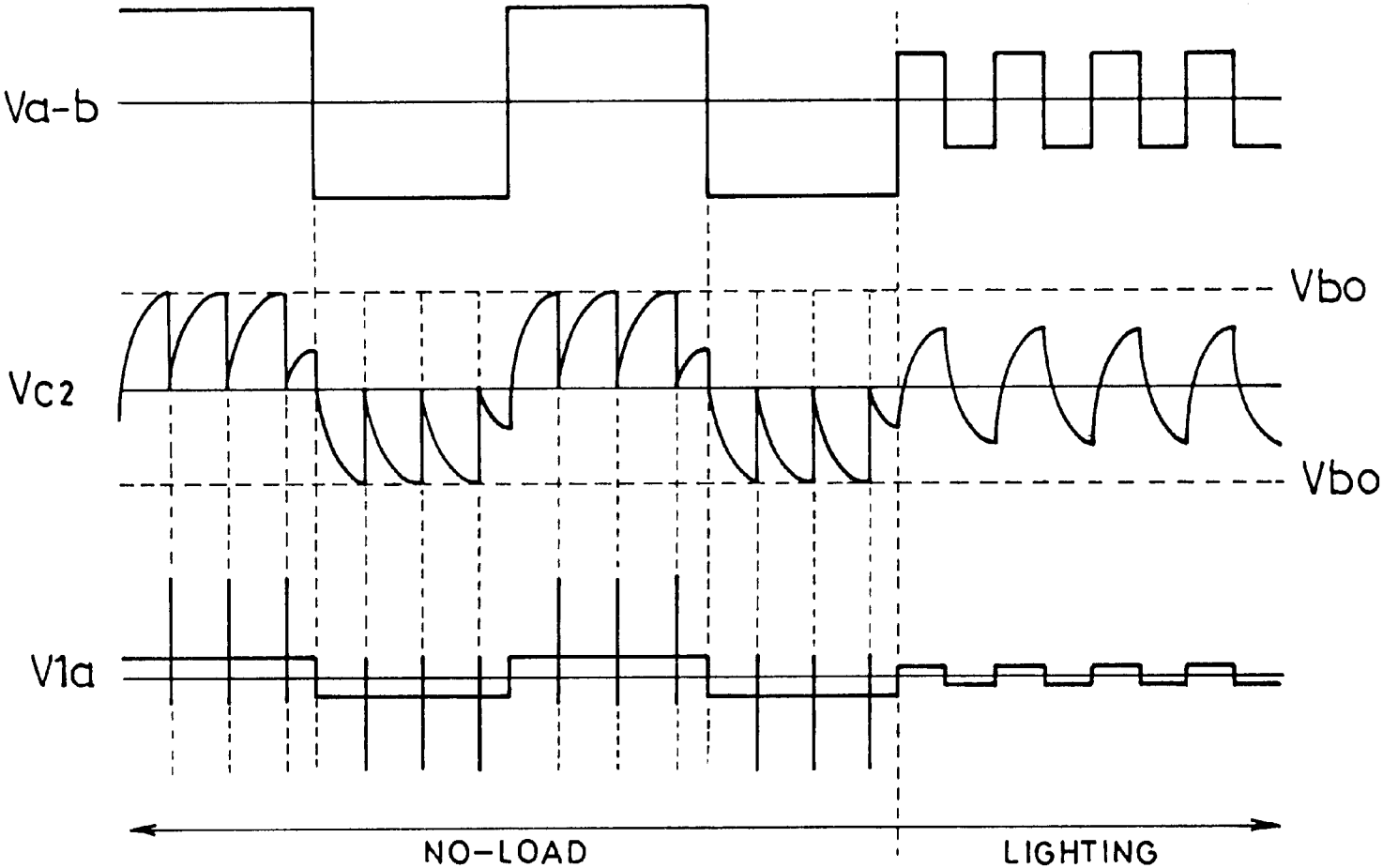
FIG. 32 is an operational waveform diagram of a known igniter circuit.
Figure 33:
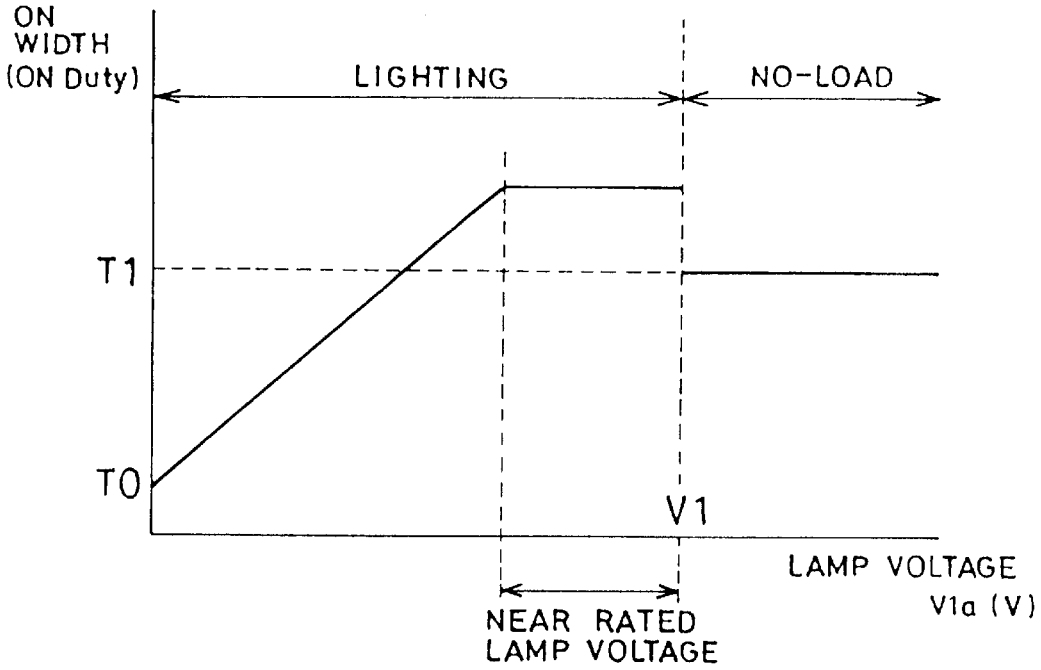
FIG. 33 (PRIOR ART)
FIG. 33 is an explanatory view for an ON width control in a known circuit.
Figure 34:
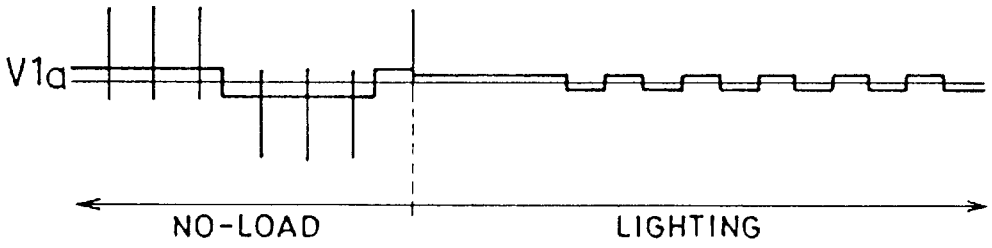
FIG. 34 (PRIOR ART)
FIG. 34 is an explanatory view for an operation of a known polarity inverting circuit.

An example of the discharge lamp lighting device embodying the present invention as a practical product is shown in FIGS. 29–31, in which FIG. 29 shows a source power input section, FIG. 30 shows a power factor improving section, and FIG. 31 shows a lighting circuit section, the respective sections being mutually connected at junctions J101–J108.

In the source power input section of FIG. 29, the AC power source AC is connected to terminals TM101 and TM102 of the device and, through a fuse FS, thermal protector TP, low resistor R100 and a filter circuit, to AC input terminals of the rectifying circuit DB to the DC output terminals of which a capacitor C109 is connected. This capacitor C109 is of a small capacity, and the actual smoothing is performed at a voltage boosting chopper circuit in the later staged power factor improving section. The filter circuit includes a zinc oxide non-linear resistor ZNR for absorbing any surge voltage, coils L105 and L106 and capacitors Cx, Cy, C108, C181 and C182, and a junction in a series circuit of the capacitors C181 and C182 is connected through a further capacitor C183 to an earthing terminal TM105.

The power factor improving section as shown in FIG. 30 comprises a voltage boosting chopper circuit including an inductor L101, a switching element Q101 and a diode D107, a full-wave rectified output of the rectifying circuit DB is received at the junction J101, and a boosted and smoothed DC voltage is obtained at an electrolytic capacitor C101 (FIG. 31) connected to the junction J102. The switching element Q101 of the voltage boosting chopper circuit is driven by the driving signal provided from the voltage boosting chopper controlling circuit 115 through resistors R171 and R172, and the current of this signal is detected by a resistor R173. A current flowing through the inductor L101 is detected by a resistor R174 connected to a secondary winding of the inductor L101. An output voltage generated at the junction 102 is detected through resistors R108 and R109, and an input voltage at the junction J101 is detected through resistors R191 and R192. An operating source power Vcc101 is supplied from the junction J101 through resistors R193 and R194 upon connection of the power source, whereas, as the switching operation of the switching element Q101 starts, a secondary winding output of the inductor L101 is rectified at diodes D171 and D172, and a DC voltage obtained at a capacitor C171 through a resistor R170 is supplied through a diode D173. This DC voltage obtained at the capacitor C171 is made to be a constant voltage by means of a three-terminal type voltage regulator IC101, so as to be an operating source power Vcc of the control circuit 116 for the lighting circuit section. This control circuit 116 detects through junctions J103–J105 the zero current, excess current and lamp voltage from the lighting circuit section of FIG. 31 and provides square wave driving signals and voltage dropping chopper driving signal through junctions J106–J108.

The lighting circuit section shown in FIG. 31 which drops the DC voltage obtained at the electrolytic capacitor C101 through the junction J102 to an optional DC voltage by means of an action of a switching element Q102, diode D102 and inductor L102, and a lamp voltage is obtained at a capacitor C102. The lamp voltage at the capacitor C102 is detected through resistors R102 and R103 and junction J105. A current flowing through an inductor L102 is detected through a resistor R104 and junction J103, and a current flowing through the voltage dropping chopper circuit section 102 is detected through the resistor R103 and junction J104. The switching element Q102 of the voltage dropping chopper circuit section 102 is driven, through a transformer T105 and resistors R151 and R152, by the driving signal supplied to the junction J108.

Next, the polarity inverting circuit section is a full bridge circuit of four switching elements Q103–Q106 which are driven respectively by means of general-use drive circuits IC102 and IC103 and through resistors R111, R112; R121, R122; R131, R132; and R141, R142. The square wave driving signals are connected through the junctions J106 and J107, and the foregoing constant voltage Vcc is supplied as the operating source power of the respective drive circuits IC102 and IC103. Further, capacitors C111, C112; C131, C132 for driving the switching elements Q103 and Q104 on the higher potential side are charged with the constant voltage Vcc through a resistor R113 and diodes D111 and D131. To output ends of the full bridge circuit, D111 and D131. To output ends of the full bridge circuit, a discharge lamp LA is connected through a pulse transformer PT of an igniter circuit 117. The discharge lamp LA is of M98 (70W) or M130 (35W) of ANSI Standard, for example, and its light emitting tube is of ceramics. The lamp LA is connected across terminals TM103 and TM104 of the pulse transformer PT.

What is claimed is:

1. A discharge lamp lighting device comprising:

a DC power source;

an inverter circuit section including switching elements which receive a DC voltage of said DC power source and provide a square wave AC voltage;

a discharge lamp receiving said square wave AC voltage to be lighted thereby;

control means for controlling said switching elements in said inverter circuit section so as to supply an energy enough for stably lighting the discharge lamp during an unstable discharge period after a start of discharge of the lamp; and means for rendering a first control amount by which said controlling means controls said switching elements for a predetermined period to be substantially identical to a second control amount of the switching elements in non-load state.

2. The device according to claim 1 which further comprises means for rendering a square wave frequency of said square wave AC voltage to the discharge lamp in the non-load state to be lower than a square wave frequency of the voltage in lamp lighting state, said control means maintaining the square wave frequency in non-load state for a fixed period immediately after a detection of the start of discharge.

3. The device according to claim 1 which further comprises means for supplying to the discharge lamp the DC voltage from the DC power source in non-load state but the square wave AC voltage in lighting state of the lamp, said control means maintaining the DC voltage in the non-load state for a fixed period immediately after a detection of the start of discharge.

4. The device according to claim 1 which further comprises a high voltage pulse generating means for applying a high voltage pulse to the discharge lamp in starting the lamp.

5. The device according to claim 1 wherein said inverter circuit section comprises a voltage dropping chopper circuit section for a voltage conversion of the DC voltage, and a polarity inverting circuit section of a full-bridge structure for converting the voltage-converted DC voltage into said square wave AC voltage.

6. The device according to claim 1 wherein said inverter circuit section comprises a full-bridge circuit for converting the DC voltage into the square wave AC voltage.

7. The device according to claim 1 wherein said inverter circuit section comprises a half-bridge circuit for converting the DC voltage into the square wave AC voltage.

8. The device according to claim 1 wherein said discharge lamp is a high pressure discharge lamp.

9. The device according to claim 8 wherein said high pressure discharge lamp is a metal halide lamp.

10. The device according to claim 9 wherein said high pressure discharge lamp is M98 (70W) or M130 (35W) in ANSI Standard.

11. The device according to claim 10 wherein said high pressure discharge lamp has a light emitting tube made of ceramics.

12. The device according to claim 1 wherein said inverter circuit section comprises a chopper circuit including at least an inductor and a switching element and providing the DC voltage as voltage-converted, a lighting circuit for stably maintaining the lighting of the discharge lamp with the voltage-converted DC voltage, and means for detecting a current flowing through-the inductor of the chopper circuit;

said control means includes a first control circuit receiving an output of said detecting means for switching said switching elements in the inverter circuit section to render the current flowing through the inductor to be discontinuous, and a second control circuit for switching the switching elements to render the current through the inductor to be continuous; and the device further comprises means for controlling the switching elements with said second control circuit immediately after the start of discharge of the lamp and changing over the second control circuit to said first control circuit before a lamp power reaches the largest value.

13. The device according to claim 12 which further comprises means for detecting the lamp voltage, detected output of which is provided to said controlling and changing over means to have the first and second control circuits changed over with the lamp voltage.

14. The device according to claim 12 which further comprises means for detecting the lamp current, detected output of which is provided to said controlling and changing over means to have the first and second control circuits changed over with the lamp current.

15. The device according to claim 12 which further comprises a timer circuit for measuring a time elapsed after the lighting of the discharge lamp to determine a time at which a rated lamp voltage reaches 30-to 50%, said determined time being provided to said controlling and changing over means for said change-over of the second control circuit to the first control circuit.

16. The device according to claim 12 which further comprises means for providing a period in which a current to the discharge lamp to be less than a lamp current at least in constant lighting state, within a term in which the lamp voltage rises from substantially zero to a predetermined value below a rated value.

17. The device according to claim 12 which further comprises means for preventing a lamp current value from discontinuously varying upon said change over of the second control circuit to the first control circuit.

18. A discharge lamp lighting device comprising:

a DC power source providing a DC voltage;

an inverter circuit section including switching elements receiving said DC voltage of said DC power source and providing a square wave AC voltage, said inverter circuit section comprising a voltage dropping chopper circuit for a voltage-conversion of the DC voltage, and a polarity inverting circuit of a full-bridge arrangement for converting the DC voltage voltage-converted into the square wave AC voltage;

a discharge lamp receiving said square wave AC voltage to be lighted thereby;

a high voltage pulse generating means for applying to said discharge lamp a high voltage pulse to start the lamp;

a control means for controlling said switching elements in said inverter circuit section so as to supply an energy enough for stably lighting the discharge lamp during an unstable discharge period after a start of discharge of the lamp;

means for lighting the discharge lamp with said square wave AC voltage of which a square wave frequency in non-load state is made lower than a square wave frequency in lighting state;

means for rendering a first control amount by which said control means controls the switching elements for a predetermined period to be substantially identical to a second control amount of the switching elements in non-load state; and means for controlling the square wave frequency in non-load state for a fixed period immediately after a detection of a start of discharge of the lamp;

wherein said discharge lamp is a high pressure discharge lamp consisting of a metal halide lamp of M98 (70W) or M130 (35W) in ANSI Standard and of a ceramic light emitting tube.

19. A discharge lamp lighting device comprising:

a DC power source providing a DC voltage;

an inverter circuit section including switching elements receiving said DC voltage of said DC power source and providing a square wave AC voltage, said inverter circuit section comprising a voltage dropping chopper circuit for a voltage-conversion of the DC voltage, and a polarity inverting circuit of a full-bridge arrangement for converting the DC voltage voltage-converted into the square wave AC voltage;

a discharge lamp receiving said square wave AC voltage to be lighted thereby;

a high voltage pulse generating means for applying to the discharge lamp a high voltage pulse to start the lamp;

a control means for controlling said switching elements in the inverter circuit section so as to supply an energy enough for stably lighting the discharge lamp in an unstable discharge period after a start of discharge of the lamp;

means for supplying to the discharge lamp the DC voltage in non-load state and the square wave AC voltage in the lighting state to light the lamp;

means for rendering a first control amount by which said control means control the switching elements for a predetermined period to be substantially identical to a second control amount in the non-load state; and means for controlling the DC voltage to the discharge lamp to be kept as it is for a fixed period immediately after a detection of the start of discharge of the lamp;

wherein said discharge lamp is a high pressure metal halide discharge lamp of M98 (70W) or M130 (35W) in ANSI Standard and of a ceramic-made light transmitting tube.

20. A discharge lamp lighting device comprising:

a DC power source providing a DC voltage;

a lighting circuit including at least switching elements, an inductor, a chopper circuit for executing a voltage-conversion of said DC voltage from said DC power source, and a discharge lamp to be maintained in a stable lighting with a square wave AC voltage obtained from said DC voltage voltage-converted;

a control means for controlling said switching elements to cause an energy sufficient for stably lighting the discharge lamp to be supplied in an unstable discharge period after a start of discharge of the lamp;

means for rendering a first control amount by which said control means controls the switching elements for a predetermined period to be substantially identical to a second control amount of the switching elements in non-load state; and means for detecting a current flowing to said inductor which is provided in said chopper circuit of said lighting circuit;

wherein said control means includes a first control circuit which receives an output of said inductor current detecting means for actuating said switching elements to render said current to the inductor to be discontinuous, a second control circuit for actuating the switching elements to render the current to the inductor to be continuous, means for changing over the control of the switching elements by means of said second control circuit immediately after the start of lighting of the lamp to the control by means of said first control circuit before a lamp power reaches the largest value, means for detecting a voltage of the discharge lamp, means responsive to an output lamp voltage of said detecting means for changing the control by the second control circuit over to that by the first control circuit, and means for preventing a lamp current from being varied to be discontinuous upon said change over from the second control circuit to the first control circuit.

* * * * *